US012612217B2

(12) United States Patent
Orlando

(10) Patent No.: US 12,612,217 B2
(45) Date of Patent: Apr. 28, 2026

(54) LAUNDRY LAB BOTTLE

(71) Applicant: Nicole Marie Orlando, New York, NY (US)

(72) Inventor: Nicole Marie Orlando, New York, NY (US)

( * ) Notice: Subject to any disclaimer, the term of this patent is extended or adjusted under 35 U.S.C. 154(b) by 161 days.

(21) Appl. No.: 18/413,664

(22) Filed: Jan. 16, 2024

(65) Prior Publication Data

US 2024/0239561 A1 Jul. 18, 2024

Related U.S. Application Data

(60) Provisional application No. 63/439,362, filed on Jan. 17, 2023.

(51) Int. Cl.
*B65D 41/08* (2006.01)
*B65D 21/02* (2006.01)

(52) U.S. Cl.
CPC ..... *B65D 41/08* (2013.01); *B65D 21/0228* (2013.01)

(58) Field of Classification Search
CPC ..... B65D 21/0228; B65D 21/0209; B65D 21/02; B65D 41/08; B65D 41/086
USPC ..... 220/23.86, 23.83, 502, 501, 505, 212.5, 220/212; 206/508, 504, 459.5
See application file for complete search history.

(56) References Cited

U.S. PATENT DOCUMENTS 5,417,327 A * 5/1995 Saumure ..... B65D 21/0228 220/592.2
2006/0278552 A1* 12/2006 Wang ..... B65D 21/083 206/505
2009/0145874 A1* 6/2009 Hite ..... B65D 51/28 220/23.86
2011/0186585 A1* 8/2011 Lu ..... A47J 41/00 220/592.2
2011/0290805 A1* 12/2011 Rances ..... B65D 81/3205 220/529
2012/0085674 A1* 4/2012 Kemper ..... B65D 43/0229 206/508
2023/0097794 A1* 3/2023 Twist ..... B65D 21/0228 220/23.87
2023/0211921 A1* 7/2023 Hon ..... B65D 51/245 220/23.83

FOREIGN PATENT DOCUMENTS

WO WO-2010089754 A1 * 8/2010 ..... A61Q 19/02

* cited by examiner

*Primary Examiner* — Robert J Hicks
(74) *Attorney, Agent, or Firm* — Jones Intellectual Property

(57) ABSTRACT

The present invention generally relates to a multi-configurational, compact apparatus for simplifying the transport and organization of laundry essentials. Addressing the challenges faced in communal laundry settings, the present invention offers a solution for carrying cumbersome items like detergent bottles and managing smaller, multiple laundry essentials, such as coins.

20 Claims, 13 Drawing Sheets

LAUNDRY LAB BOTTLE

REFERENCE TO RELATED APPLICATIONS

This application claims the benefit of and priority to U.S. Provisional Patent Application Ser. No. 63/439,362, filed on Jan. 17, 2023, and entitled THE LAUNDRY LAB BOTTLE, the entire contents of which is hereby incorporated by reference herein.

FIELD

The present invention pertains to the field of portable storage and transportation devices, specifically designed for laundry-related purposes. It falls within the domain of household utility products and extends into the realm of personal convenience and organizational tools. The present invention is particularly relevant to sectors focusing on ergonomic and efficient solutions for carrying and storing a variety of laundry essentials such as detergents, fabric softeners, and coins. This encompasses areas of interest such as personal care items, home organization, and portable container technologies.

Additionally, the present invention has relevance in the field of modular and multi-functional design, where components can be reconfigured or adjusted according to user preferences or needs. It also touches on aspects of environmentally conscious design, as it promotes the efficient use and transport of laundry supplies, potentially reducing waste and overuse. Therefore, the present invention also aligns with sustainable living practices and eco-friendly consumer products.

The present invention integrates principles and techniques from the fields of container design, modular product development, and consumer goods aimed at enhancing everyday tasks with practical, user-friendly solutions.

BACKGROUND

The need for an efficient solution to transport laundry essentials has been evident for several decades. Users of communal laundry facilities have consistently faced the cumbersome task of carrying multiple items such as laundry detergents, fabric softeners, bleach, scented beads, and coins. Users of communal laundry facilities include, among many, apartment dwellers, dormitory residents, those traveling, and those hiking. The task of carrying multiple items in these settings is particularly challenging for individuals without personal vehicles, emphasizing the need for a secure, convenient, and compact solution for transporting these items.

There is a need for a novel invention designed to resolve the difficulties associated with transporting and managing laundry supplies for users of communal laundry facilities. The conventional methods of carrying bulky and heavy detergent bottles, coupled with the need to transport various items like coins for machine operation, present significant challenges. These tasks are often physically demanding and increase the risk of spillage and loss, particularly when transported over distances. Furthermore, the traditional means of carrying coins in pockets or bags is insecure, posing a risk of loss or theft.

SUMMARY

An object of the present invention is to address the long-felt need that currently exists in transporting and managing laundry supplies for users of communal laundry facilities. Users of communal laundry facilities include, among many, apartment dwellers, dormitory residents, those traveling, and those hiking. This and other objects shall be addressed by embodiments of the present invention as set forth herein.

In embodiments, a multi-configuration apparatus comprises: a top component, comprising: a top first side, the top first side being circular in shape and comprising a top first side external threads; and a top second side, the top second side comprising a handle section including a handle opening; a first component comprising: a first chamber having a first volume, the first chamber comprising: a first chamber first side, the first chamber first side comprising a first circular opening and a first chamber first side external threads; a first chamber second side, the first chamber second side being circular in shape and comprising a first chamber second side external threads; and a first lid comprising: a first lid first side, the first lid first side being circular in shape and comprising: a first lid first side threaded insert; and a first lid first side rim, the first lid first side rim being within a circumference of the first lid; a first lid second side, the first lid second side being circular in shape and comprising: a first lid second side threaded insert; a first lid second side rim, the first lid second side rim being within the circumference of the first lid; and a first lid silicon insert, wherein the first lid silicon insert is circular in shape and positioned within the first lid second side rim, and wherein the first lid silicon insert is adjacent to and in contact with the first lid second side threaded insert, wherein the first chamber is affixed to the first lid by threaded engagement between the first chamber first side external threads and the first lid second side threaded insert; a second component comprising: a second chamber having a second volume, the second chamber comprising: a second chamber first side, the second chamber first side comprising a second circular opening and a second chamber first side external threads; a second chamber second side, the second chamber second side being circular in shape and comprising a second chamber second side external threads; and a second lid comprising: a second lid first side, the second lid first side being circular in shape and comprising: a second lid first side threaded insert; and a second lid first side rim, the second lid first side rim being within a circumference of the second lid; and a second lid second side, the second lid second side being circular in shape and comprising: a second lid second side threaded insert; a second lid second side rim, the second lid second side rim being within the circumference of the second lid; and a second lid silicon insert, wherein the second lid silicon insert is circular in shape and positioned within the second lid second side rim, and wherein the second lid silicon insert is adjacent to and in contact with the second lid second side threaded insert, wherein the second chamber is affixed to the second lid by threaded engagement between the second chamber first side external threads and the second lid second side threaded insert; and a third component comprising: a third chamber having a third volume, the third chamber comprising: a third chamber first side, the third chamber first side comprising a third circular opening and a third chamber first side external threads; and a third chamber second side, the third chamber second side being circular in shape and comprising a third chamber second side external threads; and a third lid comprising: a third lid first side, the third lid first side being circular in shape and comprising: a third lid first side threaded insert; and a third lid first side rim, the third lid first side rim being within a circumference of the third lid; and a third lid second side, the third lid second side being circular in shape and comprising: a third lid second side threaded insert; a third lid second side rim, the third lid second side rim being within the circumference of the third lid; and a third lid silicon insert, wherein the third lid silicon insert is circular in shape and positioned within the third lid second side rim, and wherein the third lid silicon insert is adjacent to and in contact with the third lid second side threaded insert, wherein the third chamber is affixed to the third lid by threaded engagement between the third chamber first side external threads and the third lid second side threaded insert, wherein the first volume is less than the second volume, wherein the first volume is less than the third volume, wherein the second volume and the third volume are the same, wherein the multiconfiguration apparatus comprises: a first configuration comprising a first order of components and a second configuration comprising a second order of components, such that the first order of components differs from the second configuration of components, wherein the first order comprises the top affixed to the first component, the first component affixed to the second component, and the second component affixed to the third component, the first component being affixed to the top by threaded engagement between the top first side external threads and first lid first side threaded insert, the second component being affixed to the first component by threaded engagement between the first chamber second side external threads and the second lid first side threaded insert, and the third component being affixed to the second component by threaded engagement between the second chamber second side external threads and the third lid first side threaded insert, wherein the first configuration has a first cylindrical shape, wherein the second order comprises the top affixed to the first component, the first component affixed to the third component, and the third component affixed to the second component, the first component being affixed to the top by threaded engagement between the top first side external threads and first lid first side threaded insert, the third component is affixed to the first component by threaded engagement between the first chamber second side external threads and the third lid first side threaded insert, and the second component is affixed to the third component by threaded engagement between the third chamber second side external threads and the second lid first side threaded insert, and wherein the second configuration has a second cylindrical shape.

In embodiments, the first configuration has a height of nine inches and a diameter of 2.25 inches.

In embodiments, the second configuration has a height of nine inches and a diameter of 2.25 inches.

In embodiments, the first chamber, the second chamber, and the third chamber are made of a material, the material consisting of Tritan.

In embodiments, the first volume is 5 fluid ounces, the second volume is 9 fluid ounces, and the third volume is 9 fluid ounces.

In embodiments, the second chamber further comprises: a first plurality of marks comprising: a first mark between the second chamber first side and the second chamber second side, such that the first marking is perpendicular to the second chamber first side and the second chamber second side; a second mark that originates from the first mark at a first point and runs perpendicular to the first mark; a third mark that originates from the first mark at a second point and runs perpendicular to the first mark; a fourth mark that originates from the first mark at a third point and runs perpendicular to the first mark; and a fifth mark that originates from the first mark at a fourth point and runs perpendicular to the first mark, wherein a first distance between the second chamber second side and the first point is equal to a second distance between the first point and the second point, wherein the second distance is equal to a third distance between the second point and the third point, and wherein the third distance is equal to a fourth distance between the third point and the fourth point.

In embodiments, the first distance measures a first amount of laundry detergent sufficient to clean one load of laundry in a washing machine, the second distance measures a second amount of laundry detergent sufficient to clean two loads of laundry, the third distance measures a third amount of laundry detergent sufficient to clean three loads of laundry, and the fourth distance measures a fourth amount of laundry detergent sufficient to clean four loads of laundry. In embodiments, one load of laundry is between 10 pounds and 18 pounds.

In embodiments, the first distance measures a first amount of fabric softener sufficient for one load of laundry in a washing machine, the second distance measures a second amount of fabric softener sufficient for two loads of laundry, the third distance measures a third amount of 1 fabric softener sufficient for three loads of laundry, and the fourth distance measures a fourth amount of fabric softener sufficient for four loads of laundry. In embodiments, one load of laundry is between 10 pounds and 18 pounds.

In embodiments, the third chamber further comprises: a second plurality of marks comprising: a sixth mark between the third chamber first side and the third chamber second side, such that the sixth marking is perpendicular to the third chamber first side and the third chamber second side; a seventh mark that originates from the sixth mark at a fifth point and runs perpendicular to the sixth mark; an eighth mark that originates from the sixth mark at a sixth point and runs perpendicular to the sixth mark; a ninth mark that originates from the sixth mark at a seventh point and runs perpendicular to the sixth mark; and a tenth mark that originates from the sixth mark at an eighth point and runs perpendicular to the sixth mark, wherein a fifth distance between the third chamber second side and the fifth point is equal to a sixth distance between the fifth point and the sixth point, wherein the sixth distance is equal to a seventh distance between the sixth point and the seventh point, and wherein the seventh distance is equal to an eighth distance between the seventh point and the fourth point.

In embodiments, the fifth distance measures a fifth amount of laundry detergent sufficient to clean one load of laundry in a washing machine, the sixth distance measures a sixth amount of laundry detergent sufficient to clean two loads of laundry, the seventh distance measures a seventh amount of laundry detergent sufficient to clean three loads of laundry, and the eighth distance measures an eighth amount of laundry detergent sufficient to clean four loads of laundry. In embodiments, one load of laundry is between 10 pounds and 18 pounds.

In embodiments, the threaded engagement between the first lid and the first chamber forms a hermetic seal, the threaded engagement between the second lid and the second chamber forms a hermetic seal, and the threaded engagement between the third lid and the third chamber forms a hermetic seal.

In embodiments, the first chamber is configured to hold fiat; the second chamber is configured to hold fabric softener, and the third chamber is configured to hold laundry detergent.

In embodiments, a multi-configuration apparatus comprises a top component, a first component and a second component, the top component comprising: a top first side comprising a top first side engagement feature; a first component comprising: a first chamber comprising: a first chamber first side, the first chamber first side comprising a first opening and first chamber first side engagement feature; a first chamber second side comprising a first chamber second side engagement feature; and a first lid comprising: a first lid first side comprising a first lid first side engagement feature insert; and a first lid second side comprising a first lid second side engagement feature insert, wherein the first chamber is affixed to the first lid by detachable engagement between the first chamber first side first engagement feature and the first lid second side engagement feature insert; a second component comprising: a second chamber comprising: a second chamber first side, the second chamber first side comprising a second opening and second chamber first side engagement feature; a second chamber second side comprising a second chamber second side engagement feature; and a second lid comprising: a second lid first side comprising a second lid first side engagement feature insert; and a second lid second side comprising a second lid second side engagement feature insert, wherein the second chamber is affixed to the second lid by detachable engagement between the second chamber first side engagement feature and the second lid second side engagement feature insert; and a third component comprising: a third chamber comprising: a third chamber first side comprising a third opening and a third chamber first side engagement feature; and a third chamber second side comprising a third chamber second side engagement feature; and a third lid comprising: a third lid first side comprising a third lid first side engagement feature insert; and a third lid second side comprising a third lid second side engagement feature insert, wherein the third chamber is affixed to the third lid by detachable engagement between the third chamber first side engagement feature and the third lid second side engagement feature insert, wherein the multiconfiguration apparatus comprises: a first configuration comprising a first order of components and a second configuration comprising a second order of components, such that the first order of components differs from the second configuration of components, wherein the first order comprises the top affixed to the first component, the first component affixed to the second component, and the second component affixed to the third component, the first component being affixed to the top by detachable engagement between the top first side engagement feature and first lid first side engagement feature insert, the second component being affixed to the first component by detachable engagement between the first chamber second side engagement feature and the second lid first side engagement feature insert, and the third component being affixed to the second component by detachable engagement between the second chamber second side engagement feature and the third lid first side engagement feature insert, wherein the second order comprises the top affixed to the first component, the first component affixed to the third component, and the third component affixed to the second component, the first component being affixed to the top by detachable engagement between first lid first side engagement feature and the top second side engagement feature insert, the third component is affixed to the first component by detachable engagement between the first chamber second side engagement feature and the third lid first side engagement feature insert, and the second component is affixed to the third component by detachable engagement between the third chamber second side engagement feature and the second lid first side engagement feature insert.

In embodiments, the first configuration has a height of less than nine inches and a diameter of less than 2.5 inches.

In embodiments, the second configuration has a height of less than nine inches and a diameter of less than 2.5 inches.

In embodiments, the first chamber has a first volume; the second chamber has a second volume; and the third chamber has a third volume, and wherein the first volume is 5 fluid ounces, the second volume is 9 fluid ounces, and the third volume is 9 fluid ounces.

In embodiments, the multi-configuration apparatus further comprises a fourth component comprising: a fourth chamber comprising: a fourth chamber first side comprising a third opening and a fourth chamber first side engagement feature; and a fourth chamber second side comprising a fourth chamber second side engagement feature; and a fourth lid comprising: a fourth lid first side comprising a fourth lid first side engagement feature insert; and a fourth lid second side comprising a fourth lid second side engagement feature insert, wherein the fourth chamber is affixed to the fourth lid by detachable engagement between the fourth chamber first side engagement feature and the fourth lid second side engagement feature insert.

BRIEF DESCRIPTION OF THE DRAWINGS

Exemplary embodiments of the present invention will be described with references to the accompanying figures, wherein.

DETAILED DESCRIPTION

The present invention described herein relates to the arena of portable storage and transportation solutions, with a specific focus on facilitating laundry-related activities. Positioned within the broader category of household utility products, it significantly contributes to personal convenience and organizational effectiveness. This invention is especially pertinent to the development of ergonomic and efficient methods for transporting and storing various laundry necessities, including but not limited to detergents, fabric softeners, and coins. Its relevance spans across several areas, encompassing personal care, home organization, and innovations in portable container technologies.

Further, this invention finds its significance in the realm of modular and adaptable design. It offers the flexibility for users to tailor the components based on individual preferences and requirements. In line with contemporary concerns for sustainability, the present invention also underscores the importance of efficient usage and transportation of laundry supplies, thereby aiding in the reduction of waste and unnecessary consumption. As such, it harmoniously aligns with the principles of sustainable, minimalist living and the growing demand for eco-friendly consumer products.

In its essence, the present invention amalgamates key concepts and methodologies from the domains of container design and modular product development. Its orientation towards consumer goods is directed at simplifying and enhancing routine tasks through innovative, user-centric solutions. The result is a product that not only addresses functional needs but also elevates the efficiency and convenience of everyday household chores.

The present invention, including the multi-configuration apparatus configured for more than one use, represents a significant innovation in the field of laundry management. This multi-configuration apparatus, with its modular design, is adaptable to the specific needs of users. The apparatus, which in some embodiments adopts a cylindrical form for ease of transport and handling, comprises a plurality of components and a top, each contributing to the overall utility of the invention in a novel and non-obvious manner. The present invention's size, configurations, and utility represent a novel solution to a long-felt need associated with communal laundry facilities.

The present invention not only meets the long-felt need for a more practical and secure method of transporting laundry essentials, but also introduces several novel and non-obvious features that collectively enhance the user experience for individuals frequenting communal laundry facilities. Individuals such as, among many, apartment dwellers, dormitory residents, those traveling, and those hiking. The multi-configuration apparatus, with its innovative design and user-centric features, stands as a significant advancement in the field of laundry management and transportation solutions.

Figure 1:
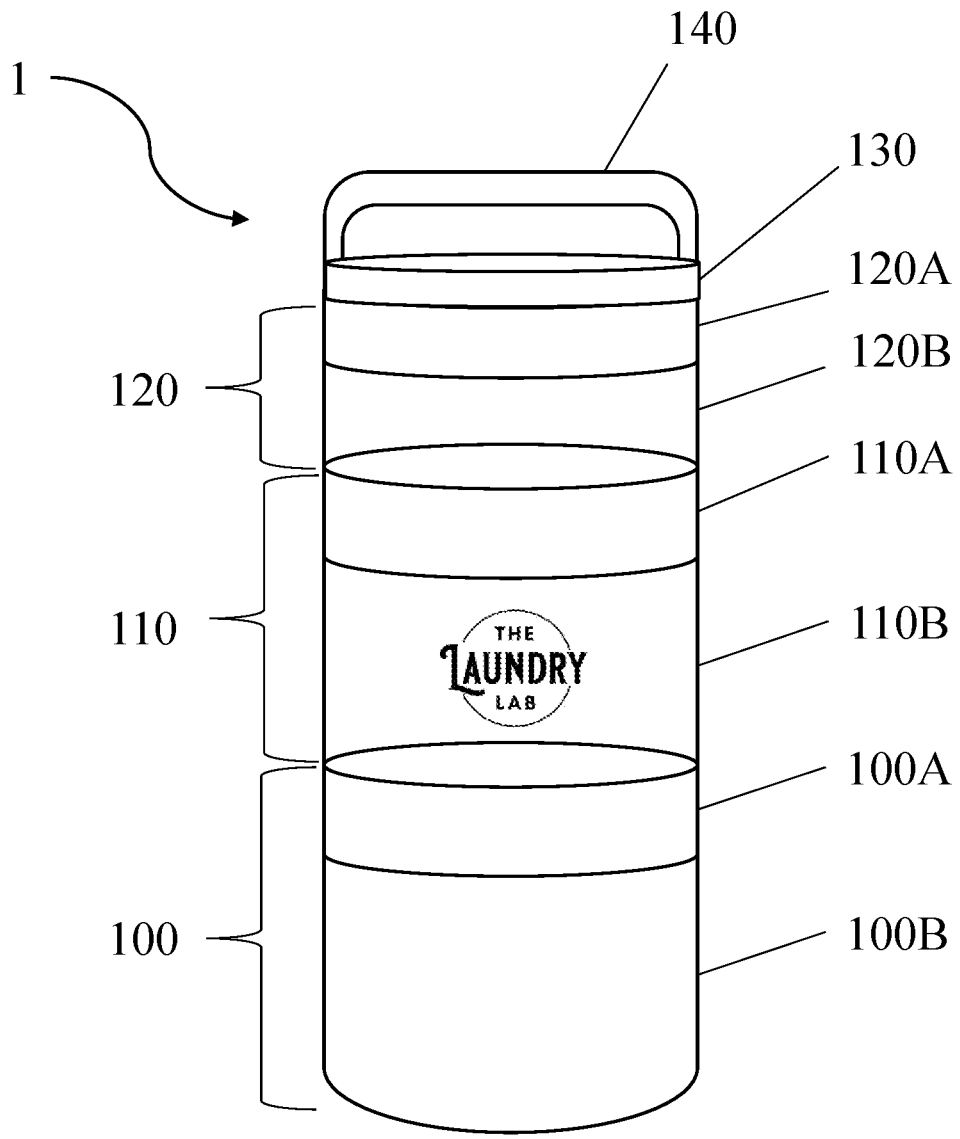
FIG. 1 is a schematic diagram of a multi-configuration apparatus in accordance with exemplary embodiments of the present invention.

Referring to FIG. 1, Multi-Configuration Apparatus 1, may, in embodiments, include First Component 100; Second Component 110; Third Component 120, and Top 130. Top 130 may include Handle 140. In embodiments, First Component 100, Second Component 110, and Third Component 120, may each include a lid (i.e., First Lid 100A; Second Lid 110A; and Third Lid 120A, respectively) and a hollow chamber (i.e., First Chamber 100B; Second Chamber 110B; and Third Chamber 120B, respectively). In embodiments, one or more of the hollow chambers have a maximum capacity ranging from five to nine fluid ounces. The combination of lid and chamber, in embodiments, forms a hermetic seal, ensuring the component is leak-proof and airtight. In embodiments, detaching a lid (i.e., First Lid 100A; Second Lid 110A; and Third Lid 120A, respectively) and a hollow chamber (i.e., First Chamber 100B; Second Chamber 110B; and Third Chamber 120B, respectively) does not effect the hermetic seal of the remaining detachably engaged lids and hollow chambers. The multi-configuration apparatus 1, in embodiments, is configured to be reusable (i.e., used more than one time). In embodiments, First Lid 100A, Second Lid 110A, Third Lid 120A, and Top 130 may be made of PP Thermoplastic. In embodiments, First Chamber 100B, Second Chamber 110B, and Third Chamber 120B may be made of Tritan. Tritan, in embodiments, is used as the material for First Chamber 100B, Second Chamber 110B, and Third Chamber 120B because Tritan is configured to hold corrosive liquid laundry detergent, liquid fabric softener, liquid stain remover or pre-treatment, color-safe bleach, bleach, delicate fabric detergent, HE (High Efficiency) laundry detergent, eco-friendly, laundry detergent, liquid detergent for baby clothes, sports laundry detergent, dryer sheets, and dark care laundry detergent, to name a few. Further, Tritan is configured to be translucent. The translucent properties of the Tritan enable users to identify the contents of First Chamber 100B, Second Chamber 110B, and Third Chamber 120B. Further, the translucent properties of Tritan enable users to identify the amount of said contents within First Chamber 100B, Second Chamber 110B, and Third Chamber 120B (e.g., using First Markings 350 and/or Second Markings 550). In embodiments, the First Chamber 100B, Second Chamber 110B, and Third Chamber 120B may be translucent.

Figure 2A:
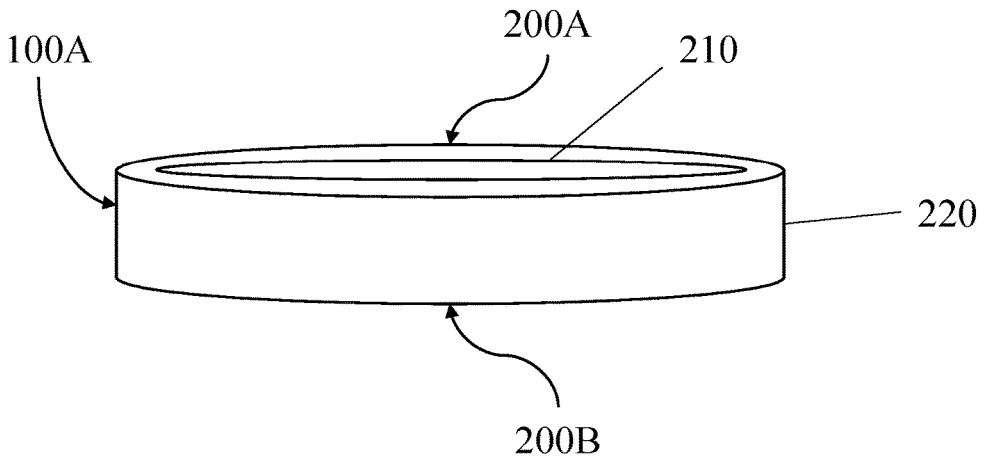
FIG. 2A is a top perspective view of a lid of a first component of the multi-configuration apparatus represented in FIG. 1, in accordance with exemplary embodiments of the present invention.
Figure 2B:
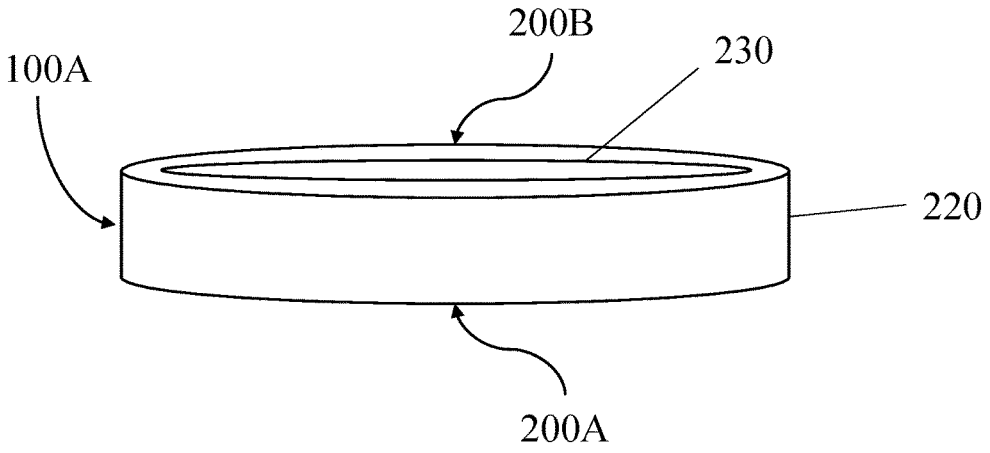
FIG. 2B is a bottom perspective view of a lid of a first component of the multi-configuration apparatus represented in FIG. 1, in accordance with exemplary embodiments of the present invention.
Figure 2C:
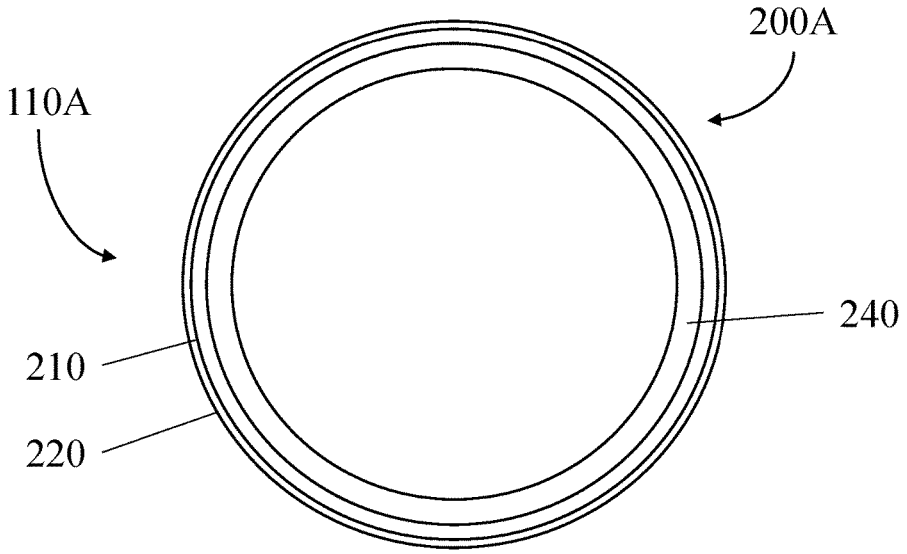
FIG. 2C is a top view of a lid of a second component of the multi-configuration apparatus represented in FIG. 1, in accordance with exemplary embodiments of the present invention.
Figure 2D:
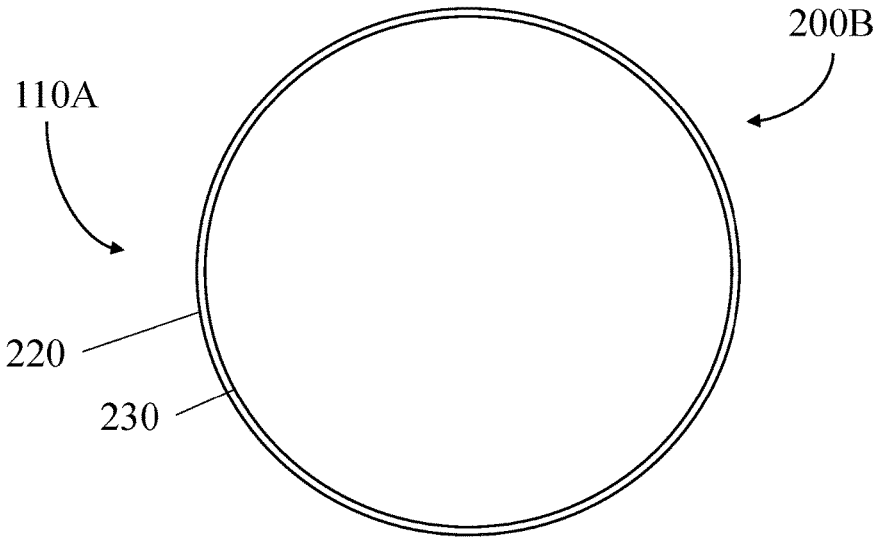
FIG. 2D is a bottom view of a lid of a second component of the multi-configuration apparatus represented in FIG. 1, in accordance with exemplary embodiments of the present invention.

First Component 100, in embodiments, includes First Lid 100A, and First Chamber 100B. Referring to FIGS. 2A, 2B, 2C and 2D, a top-perspective bottom-perspective, top, and bottom view of First Lid 100A respectively, First Lid 100A includes First Top 200A, First Bottom 200B, First Upper Engagement Insert 210 (as shown in FIG. 2A and FIG. 2C), First Circumference 220, First Lower Engagement Insert 230 (as shown in FIG. 2B and FIG. 2D), and First Silicone Ring 240 (as shown in FIG. 2C).

First Upper Engagement Insert 210 may be embedded within the interior rim of First Top 200A. In embodiments, the diameter of the embedded First Upper Engagement Insert 210 is configured to receive the diameter of Second Lower Feature 540. The depth of the embedded First Engagement Insert 210 is, in embodiments, configured to receive all Second Lower Feature 540 such that the interior rim of First Top 200A is adjacent to and in contact with Second hollow Chamber 530. In embodiments, First Silicone Ring 240 may be embedded within the interior rim of First Top 200A. First Silicone Ring 240, in embodiments, may be located inside First Upper Engagement insert 210 such that First Silicone Ring 240 is in contact with First Upper Engagement insert 210. First Silicone Ring 240 may be configured to ensure a hermetic seal between a detachably engaged First Lid 100A and First Chamber 100B.

In embodiments, First Upper Engagement Insert 210 may include threading configured to be affixed by threaded engagement to external threads on Second Lower Feature 540.

In embodiments, First Upper Engagement Insert 210 may be protruding from within the interior rim of First Top 200A. In embodiments, the diameter of the embedded First Upper Engagement Insert 210 is configured to be received within a diameter of an embedded Second Lower Feature 540. The height of the protruding First Upper Engagement Insert 210 is, in embodiments, configured to fit completely inside the embedded Second Lower Feature 540 such that the interior rim of First Top 200A is adjacent to and in contact with Second hollow Chamber 530.

First Lower Engagement Insert 230 may be embedded within the interior rim of First Bottom 200B. In embodiments, the diameter of the embedded First Lower Engagement Insert 230 is configured to receive the diameter of First Upper Feature 320. The depth of the embedded First Lower Engagement Insert 230 is, in embodiments, configured to receive all First Upper Feature 320 such that the interior rim of First Bottom 200B is adjacent to and in contact with First hollow Chamber 330.

In embodiments, First Lower Engagement Insert 230 may include threading configured to be affixed by threaded engagement to external threads on First Upper Feature 320.

In embodiments, First Lower Engagement Insert 230 may be protruding from within the interior rim of First Bottom 200B. In embodiments, the diameter of the embedded First Lower Engagement Insert 230 is configured to be received within a diameter of an embedded First Upper Feature 320. The height of the protruding First Lower Engagement Insert 230 is, in embodiments, configured to fit completely inside the embedded First Upper Feature 320 such that the interior rim of First Bottom 200B is adjacent to and in contact with First hollow Chamber 330.

In embodiments, First Circumference 220 may be circular in shape and have a radius similar to that of Multi-Configuration Apparatus 1. First Circumference 220 may have the same radius as First hollow Chamber 330. In embodiments, First Circumference 220 may have a smaller radius than the radius of First hollow Chamber 330. First Circumference 220 may have a larger radius than First hollow Chamber 330.

Figure 3A:
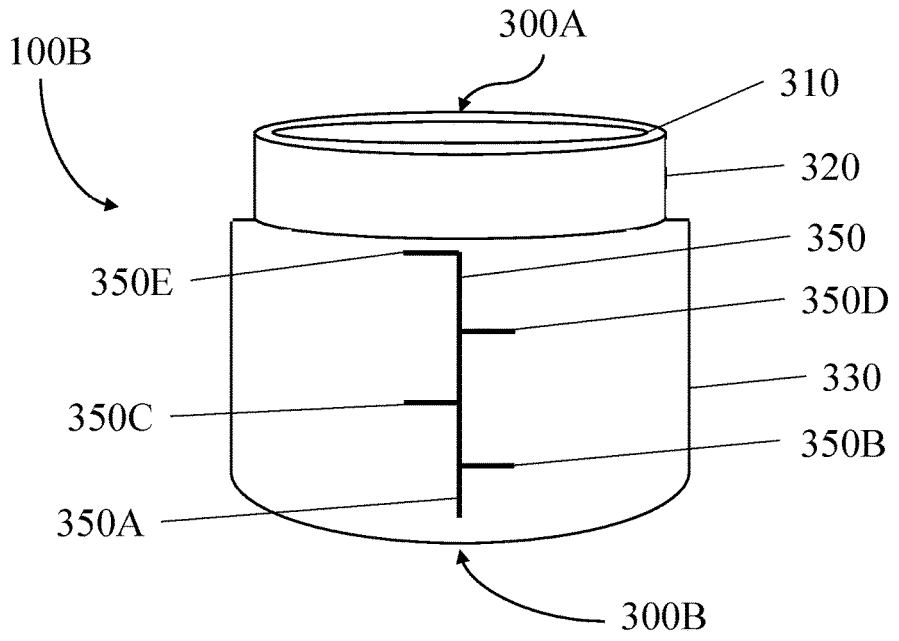
FIG. 3A is a top perspective view of a chamber of a first component of the multi-configuration apparatus represented in FIG. 1, in accordance with exemplary embodiments of the present invention.
Figure 3B:
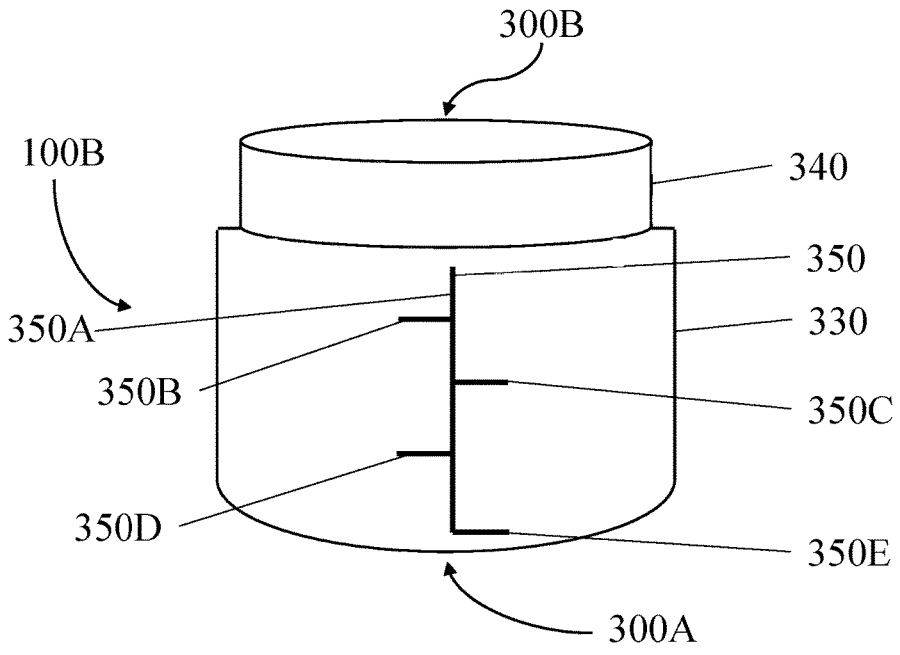
FIG. 3B is a bottom perspective view of a chamber of a first component of the multi-configuration apparatus represented in FIG. 1, in accordance with exemplary embodiments of the present invention.

Referring back to FIG. 1, First Component 100 includes First Lid 100A, and First Chamber 100B. Referring to FIGS. 3A and 3B, a top-perspective and bottom-perspective view of First Chamber 100B, respectively, First Chamber 100B includes First Chamber Top 300A; First Chamber Bottom 300B; First Opening 310; First Upper Feature 320; First hollow Chamber 330; First Lower Feature 340; and First Markings 350. First Markings, as shown in FIGS. 3A and 3B, may include First Mark 350A, which runs perpendicular to First Chamber Top 300A and First Chamber Bottom 300B, Second Mark 350B, Third Mark 350C; Fourth Mark 350D, and Fifth Mark 350E, each of the Second Mark 350B through the Fifth Mark 350E running perpendicular to First Mark 350A. In embodiments, First Chamber 100B may include additional markings. Further, First Chamber 100B, in embodiments, may include markings on one or more sides of First Chamber 100B.

First Opening 310 is a designed aperture through which the contents of First hollow Chamber 330 can be accessed or deposited. First Opening 310, as shown in FIG. 3A, is located at First Chamber Top 300A. First Opening 310, in embodiments, is circular in shape and is proportionate in size to First Component 100. The proportion in size, for example, may be First Opening 310 diameter to First Component 100 height (the height of First Component 100 is the distance between First Chamber Bottom 300B and First Top 200A). As an exemplary range, a First Opening 310 diameter to First Component 100 height ratio, First Opening 310 diameter may comprise 125% to 250% of First Component 100 height. For example, First Opening 310 diameter may be 125% of First Component 100 height. For instance, being 125% of First Component 100 height, if First Opening 310 diameter is 2.25 inches, First Component 100 height is 2 inches. As another example, First Opening 310 diameter may be 250% of First Component 100 height. For instance, being 250% of First Component 100 height, if First Opening 310 diameter is 2.25 inches, First Component 100 height is 1 inch.

First Opening 310 is configured to be hermetically sealed when First Chamber 100B is detachably engaged to First Lid 100A. As shown in FIG. 3A, First Opening 310, is an opening within First Upper Feature 320. First Upper Feature 320 may protrude from First hollow Chamber 330. In embodiments, the diameter of the protruding First Upper Feature 320 is configured to be received by First Lower Engagement Insert 230. The height of the protruding First Upper Feature 320, in embodiments, is configured such that when First Upper Feature 320 is detachably engaged with First Lower Engagement Insert 230, First hollow Chamber 330 is adjacent to and in contact with the interior of the rim of First Bottom 200B.

In embodiments, First Upper Feature 320 may include exterior threads, which may be on the outer rim or interior rim of First Upper Feature 320. The exterior threads may be configured to be affixed by threaded engagement to a threaded insert of First Bottom 200B (i.e., First Lower Engagement Insert 230).

First Upper Feature 320 may be embedded within the interior of First hollow Chamber 330. In embodiments, the diameter of the embedded First Upper Feature 320 is configured to receive the diameter of First Lower Engagement Insert 230. The depth of the embedded First Upper Feature 320, in embodiments, is configured such that when First Upper Feature 320 is detachably engaged with First Lower Engagement Insert 230, First hollow Chamber 330 is adjacent to and in contact with the interior of the rim of First Bottom 200B.

In embodiments, First Opening 310 may include external threads along a perimeter around First Opening 310, the external threads being configured to detachably engage to First Lid 100A.

First hollow Chamber 330 is an enclosed space within First Component 100 and is configured to receive and store liquid laundry detergent, liquid fabric softener, liquid stain remover or pre-treatment, color-safe bleach, bleach, delicate fabric detergent, HE (High Efficiency) laundry detergent, eco-friendly, laundry detergent, liquid detergent for baby clothes, sports laundry detergent, scented laundry beads, dryer sheets, and dark care laundry detergent, to name a few. First hollow Chamber 330, in embodiments, is made of a translucent material, for example, Tritan. First hollow Chamber 330, in embodiments, has a volume of 9 fluid ounces. In embodiments, the First hollow Chamber 330 has a volume of 5 fluid ounces. The First hollow Chamber 330 may include markings to measure the contents of First hollow Chamber 330. For example, First Measurement Markings 350 may measure the amount of laundry detergent for one load of laundry. Referring to FIG. 3A, Second Mark 350B, Third Mark 350C; Fourth Mark 350D, and Fifth Mark 350E, in embodiments, measure the amount of laundry detergent required for a load of laundry. A load of laundry, in embodiments, is between 10 pounds and 18 pounds. In embodiments, First Measurement Markings 350 may account for specific types of loads of laundry, for example, First Measurement Markings 350 may measure by the amount of small loads of laundry. As another example, First Measurement Markings 350 may measure by the amount of large loads of laundry. A load of laundry may include 4-5 pairs of adult-sized jeans or pants, 5-6 t-shirts or similar tops, 10-12 pairs of underwear, and 10-12 pairs of socks. Another exemplary load of laundry could include 10-12 standard bath towels. Yet another example may include one set of queen-sized bed sheets (fitted sheet, flat sheet, and two pillowcases). In another example, a load of laundry may include 2-3 single bed sheet sets. In another example, a load of laundry may include 10-12 dress shirts or blouses. In another example, a load of laundry may include 10-15 children's shirts or tops, 10-15 pairs of children's pants or shorts, and 10-15 pairs of children's underwear and socks. In another example, one load of laundry may include 10-15 pieces of delicate clothing such as lingerie, silk garments, or lightweight blouses. In another example, a load of laundry may include 5-6 pairs of leggings or workout pants, 5-6 workout tops or t-shirts, and 5-6 pairs of athletic socks. The above exemplary loads of laundry are not exhaustive and are meant to be explanatory.

In embodiments, Second Mark 350B may refer to the amount of liquid detergent required to wash one load of laundry. In embodiments, Third Mark 350C may refer to the amount of liquid detergent required to wash two loads of laundry. In embodiments, Fourth Mark 350D may refer to the amount of liquid detergent required to wash three loads of laundry. In embodiments, Fifth Mark 350E may refer to the amount of liquid detergent required to wash four loads of laundry. In embodiments, additional markings may be added or taken away to account for additional loads of laundry. For example, if First hollow Chamber 330 has a volume sufficient to hold enough laundry detergent for 6 loads of laundry, First Measurement Markings 350 may include additional markings to measure the amount of laundry detergent for a fifth and sixth load of laundry. Conversely, for example, if First hollow Chamber 330 has a volume sufficient to hold enough laundry detergent for 2 loads of laundry, First Measurement Markings 350 may only include enough markings for measuring 2 loads of laundry (i.e., First Mark 350A, Second Mark 350B, and Third Mark 350C).

As shown in FIG. 3B, First Lower Feature 340 may protrude from First hollow Chamber 330. In embodiments, the diameter of the protruding First Lower Feature 340 is configured to be received by an upper engagement insert of the Multi-Configuration Apparatus 1 (i.e., First Upper Engagement Insert 210, First Lower Engagement Insert 230, Second Upper Engagement Insert 410, Second Lower Engagement Insert 430, Third Upper Engagement Insert 610, Third Lower Engagement Insert 630).

The height of the protruding First Lower Feature 340, in embodiments, is configured such that when First Lower Feature 340 is detachably engaged with an upper engagement insert of the Multi-Configuration Apparatus 1, First hollow Chamber 330 is adjacent to and in contact with the interior of the rim of a top of an upper engagement insert of the Multi-Configuration Apparatus 1.

In embodiments, First Lower Feature 340 may include exterior threads, which may be on the outer rim or interior rim of First Lower Feature 340. The exterior threads may be configured to be affixed by threaded engagement to an upper engagement insert of the Multi-Configuration Apparatus 1 (e.g., a threaded insert of Second Upper Engagement Insert 410).

Figure 4A:
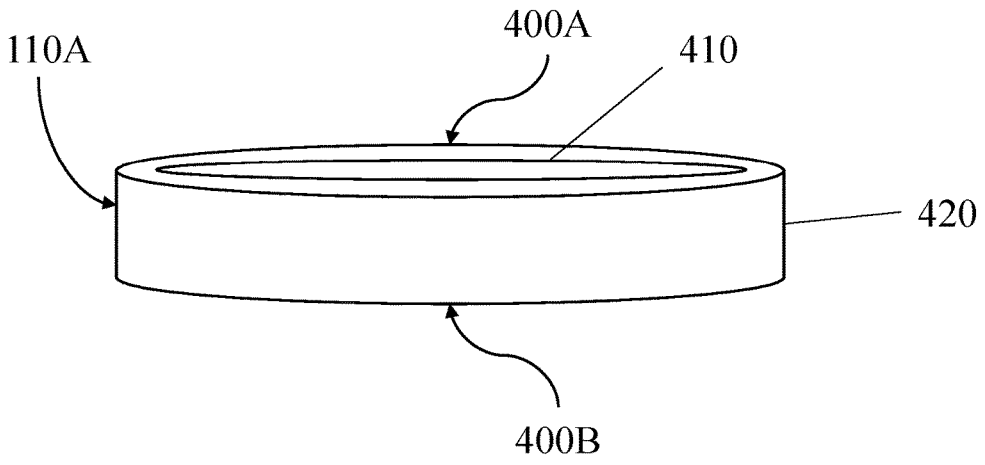
FIG. 4A is a top perspective view of a lid of a second component of the multi-configuration apparatus represented in FIG. 1, in accordance with exemplary embodiments of the present invention.
Figure 4B:
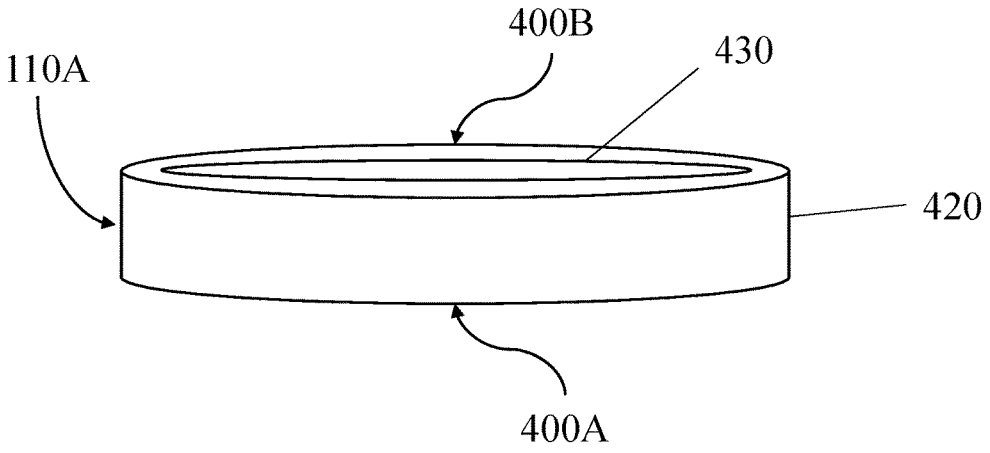
FIG. 4B is a bottom perspective view of a lid of a second component of the multi-configuration apparatus represented in FIG. 1, in accordance with exemplary embodiments of the present invention.
Figure 4C:
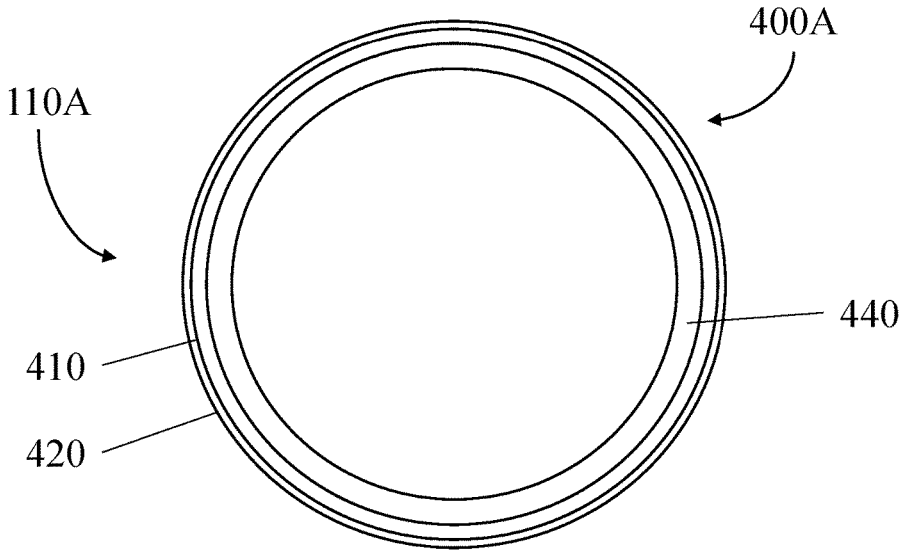
FIG. 4C is a top view of a lid of a second component of the multi-configuration apparatus represented in FIG. 1, in accordance with exemplary embodiments of the present invention.
Figure 4D:
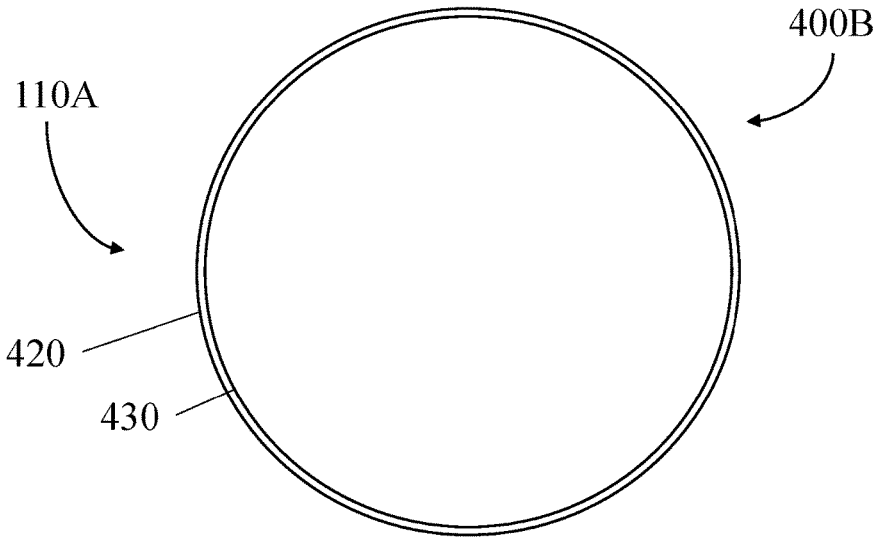
FIG. 4D is a bottom view of a lid of a second component of the multi-configuration apparatus represented in FIG. 1, in accordance with exemplary embodiments of the present invention.

Referring back to FIG. 1, Second Component 110, in embodiments, includes Second Lid 110A, and Second Chamber 110B. Referring to FIGS. 4A, 4B, 4C, and 4D, a top-perspective, bottom-perspective, top, and bottom view of Second Lid 110A respectively, Second Lid 110A includes Second Top 400A, Second Bottom 400B, Second Upper Engagement Insert 410 (as shown in FIG. 4A and FIG. 4C), Second Circumference 420, Second Lower Engagement Insert 430 (as shown in FIG. 4B and FIG. 4D), and Second Silicone Ring 440 (as shown in FIG. 4C).

Second Upper Engagement Insert 410 may be embedded within the interior rim of Second Top 400A. In embodiments, the diameter of the embedded Second Upper Engagement Insert 410 is configured to receive the diameter of Third Lower Feature 740. The depth of the embedded Second Engagement Insert 410 is, in embodiments, configured to receive all Third Lower Feature 740 such that the interior rim of Second Top 400A is adjacent to and in contact with Third hollow Chamber 730. In embodiments, Second Silicone Ring 440 may be embedded within the interior rim of Second Top 400A. Second Silicone Ring 440, in embodiments, may be located inside Second Upper Engagement insert 410 such that Second Silicone Ring 440 is in contact with Second Upper Engagement insert 410. Second Silicone Ring 440 may be configured to ensure a hermetic seal between a detachably engaged Second Lid 110A and Second Chamber 110B.

In embodiments, Second Upper Engagement Insert 410 may include threading configured to be affixed by threaded engagement to external threads on Third Lower Feature 740.

In embodiments, Second Upper Engagement Insert 410 may be protruding from within the interior rim of Second Top 400A. In embodiments, the diameter of the embedded Second Upper Engagement Insert 410 is configured to be received within a diameter of an embedded Third Lower Feature 740. The height of the protruding Second Upper Engagement Insert 410 is, in embodiments, configured to fit completely inside the embedded Third Lower Feature 740 such that the interior rim of Second Top 400A is adjacent to and in contact with Third hollow Chamber 730.

Second Lower Engagement Insert 430 may be embedded within the interior rim of Second Bottom 400B. In embodiments, the diameter of the embedded Second Lower Engagement Insert 430 is configured to receive the diameter of Second Upper Feature 520. The depth of the embedded Second Lower Engagement Insert 430 is, in embodiments, configured to receive all Second Upper Feature 520 such that the interior rim of Second Bottom 400B is adjacent to and in contact with Second hollow Chamber 530.

In embodiments, Second Lower Engagement Insert 430 may include threading configured to be affixed by threaded engagement to external threads on Second Upper Feature 520.

In embodiments, Second Lower Engagement Insert 430 may be protruding from within the interior rim of Second Bottom 400B. In embodiments, the diameter of the embedded Second Lower Engagement Insert 430 is configured to be received within a diameter of an embedded Second Upper Feature 520. The height of the protruding Second Lower Engagement Insert 430 is, in embodiments, configured to fit completely inside the embedded Second Upper Feature 520 such that the interior rim of Second Bottom 400B is adjacent to and in contact with Second hollow Chamber 530.

In embodiments, Second Circumference 420 may be circular in shape and have a radius similar to that of Multi-Configuration Apparatus 1. Second Circumference 420 may have the same radius as Second hollow Chamber 530. In embodiments, Second Circumference 420 may have a smaller radius than the radius of Second hollow Chamber 530. Second Circumference 420 may have a larger radius than Second hollow Chamber 530.

Figure 5A:
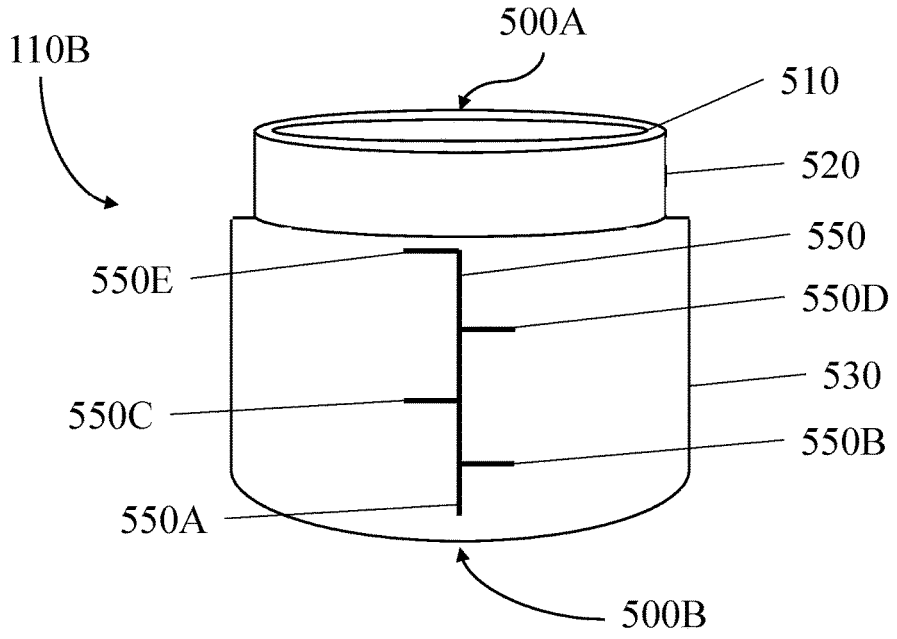
FIG. 5A is a top perspective view of a chamber of a second component of the multi-configuration apparatus represented in FIG. 1, in accordance with exemplary embodiments of the present invention.
Figure 5B:
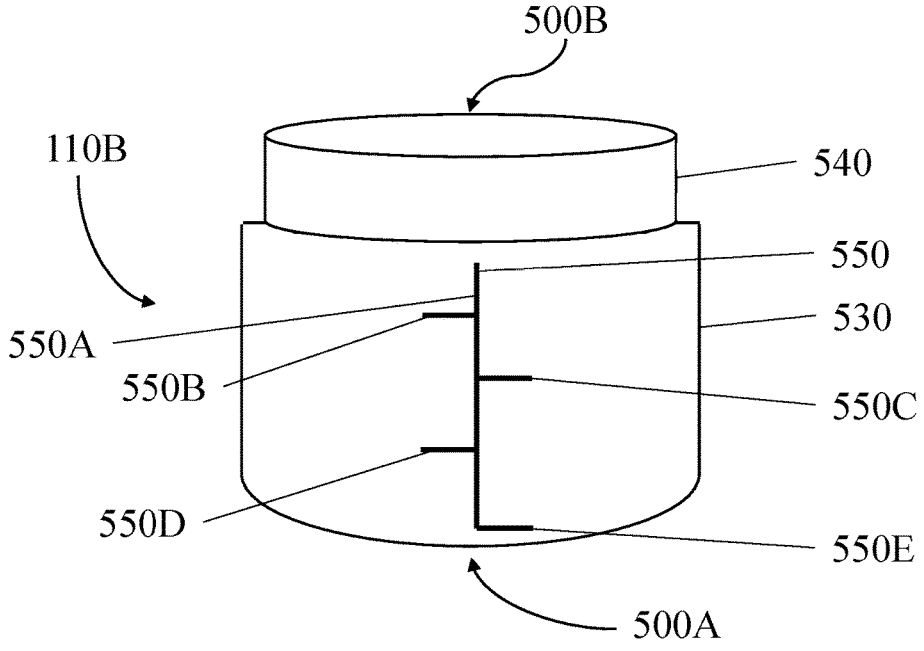
FIG. 5B is a bottom perspective view of a chamber of a second component of the multi-configuration apparatus represented in FIG. 1, in accordance with exemplary embodiments of the present invention.

Referring back to FIG. 1, Second Component 110 includes Second Lid 110A, and Second Chamber 110B. Referring to FIGS. 5A and 5B, a top-perspective and bottom-perspective view of Second Chamber 110B, respectively, Second Chamber 110B includes Second Chamber Top 500A; Second Chamber Bottom 500B; Second Opening 510; Second Upper Feature 520; Second hollow Chamber 530; Second Lower Feature 540; and Second Markings 550. Second Markings, as shown in FIGS. 5A and 5B, may include Sixth Mark 550A, which runs perpendicular to Second Chamber Top 500A and Second Chamber Bottom 500B, Seventh Mark 550B, Eighth Mark 550C; Ninth Mark 550D, and Tenth Mark 550E, each of the Seventh Mark 550B through the Tenth Mark 550E running perpendicular to Sixth Mark 550A. In embodiments, Second Chamber 110B may include additional markings. Further, Second Chamber 110B, in embodiments, may include markings on one or more sides of Second Chamber 110B.

Second Opening 510 is a designed aperture through which the contents of Second hollow Chamber 530 can be accessed or deposited. Second Opening 510, as shown in FIG. 5A, is located at Second Chamber Top 500A. Second Opening 510, in embodiments, is circular in shape and proportionate in size to Second Component 110. The proportion in size, for example, may be Second Opening 510 diameter to Second Component 110 height (the height of Second Component 110 is the distance between Second Chamber Bottom 500B and Second Top 400A). As an exemplary range, a Second Opening 510 diameter to Second Component 110 height ratio, Second Opening 510 diameter may comprise 125% to 250% of Second Component 110 height. For example, Second Opening 510 diameter may be 125% of Second Component 110 height. For instance, being 125% of Second Component 110 height, if Second Opening 510 diameter is 2.25 inches, Second Component 110 height is 2 inches. As another example, Second Opening 510 diameter may be 250% of Second Component 110 height. For instance, being 250% of Second Component 110 height, if Second Opening 510 diameter is 2.25 inches, Second Component 110 height is 1 inch.

Second Opening 510 is configured to be hermetically sealed when Second Chamber 110B is detachably engaged to Second Lid 110A. As shown in FIG. 5A, Second Opening 510, is an opening within Second Upper Feature 520. Second Upper Feature 520 may protrude from Second hollow Chamber 530. In embodiments, the diameter of the protruding Second Upper Feature 520 is configured to be received by Second Lower Engagement Insert 430. The height of the protruding Second Upper Feature 520, in embodiments, is configured such that when Second Upper Feature 520 is detachably engaged with Second Lower Engagement Insert 430, Second hollow Chamber 530 is adjacent to and in contact with the interior of the rim of Second Bottom 400B.

In embodiments, Second Upper Feature 520 may include exterior threads, which may be on the outer rim or interior rim of Second Upper Feature 520. The exterior threads may be configured to be affixed by threaded engagement to a threaded insert of Second Bottom 400B (i.e., Second Lower Engagement Insert 430).

Second Upper Feature 520 may be embedded within the interior of Second hollow Chamber 530. In embodiments, the diameter of the embedded Second Upper Feature 520 is configured to receive the diameter of Second Lower Engagement Insert 430. The depth of the embedded Second Upper Feature 520, in embodiments, is configured such that when Second Upper Feature 520 is detachably engaged with Second Lower Engagement Insert 430, Second hollow Chamber 530 is adjacent to and in contact with the interior of the rim of Second Bottom 400B.

In embodiments, Second Opening 510 may include external threads along a perimeter around Second Opening 510, the external threads being configured to detachably engage to Second Lid 110A.

Second hollow Chamber 530 is an enclosed space within Second Component 110 and is configured to receive and store liquid laundry detergent, liquid fabric softener, liquid stain remover or pre-treatment, color-safe bleach, bleach, delicate fabric detergent, HE (High Efficiency) laundry detergent, eco-friendly, laundry detergent, liquid detergent for baby clothes, scented laundry beads, dryer sheets, sports laundry detergent, and dark care laundry detergent, to name a few. Second hollow Chamber 530, in embodiments, is made of a translucent material, for example, Tritan. Second hollow Chamber 530, in embodiments, has a volume of 9 fluid ounces. In embodiments, Second hollow Chamber 530 has a volume of 5 fluid ounces. Second hollow Chamber 530 may include markings to measure the contents of First hollow Chamber 330. For example, Second Measurement Markings 550 may measure the amount of fabric softener for one load of laundry. Referring to FIG. 5A, Seventh Mark 550B, Eighth Mark 550C; Ninth Mark 550D, and Tenth Mark 550E, in embodiments, measure the amount of fabric softener required for a load of laundry.

In embodiments, Seventh Mark 550B may refer to the amount of fabric softener required to wash one load of laundry. In embodiments, Eighth Mark 550C may refer to the amount of fabric softener required to wash two loads of laundry. In embodiments, Ninth Mark 550D may refer to the amount of fabric softener required to wash three loads of laundry. In embodiments, Tenth Mark 550E may refer to the amount of fabric softener required to wash four loads of laundry. In embodiments, additional markings may be added or taken away to account for additional loads of laundry. For example, if Second hollow Chamber 530 has a volume sufficient to hold enough fabric softener for 6 loads of laundry, Second Measurement Markings 550 may include additional markings to measure the amount of fabric softener for a fifth and sixth load of laundry. Conversely, for example, if Second hollow Chamber 530 has a volume sufficient to hold enough fabric softener for 2 loads of laundry, Second Measurement Markings 550 may only include enough markings for measuring 2 loads of laundry (i.e., Sixth Mark 550A, Seventh Mark 550B, and Eighth Mark 550C). A load of laundry, in embodiments, is between 10 pounds and 18 pounds. In embodiments, Second Measurement Markings 550 may account for specific types of loads of laundry, for example, Second Measurement Markings 550 may measure by the amount of small loads of laundry. As another example, Second Measurement Markings 550 may measure by the amount of large loads of laundry.

As shown in FIG. 5B, Second Lower Feature 540 may protrude from Second hollow Chamber 530. In embodiments, the diameter of the protruding Second Lower Feature 520 is configured to be received by First Upper Engagement Insert 210. The height of the protruding Second Lower Feature 540, in embodiments, is configured such that when Second Lower Feature 540 is detachably engaged with First Upper Engagement Insert 210, Second hollow Chamber 530 is adjacent to and in contact with the First Component 100. In embodiments, Second Lower Feature 540 may include exterior threads, which may be on the outer rim or interior rim of Second Lower Feature 540. The exterior threads may be configured to be affixed by threaded engagement to First Upper Engagement Insert 210.

Figure 6A:
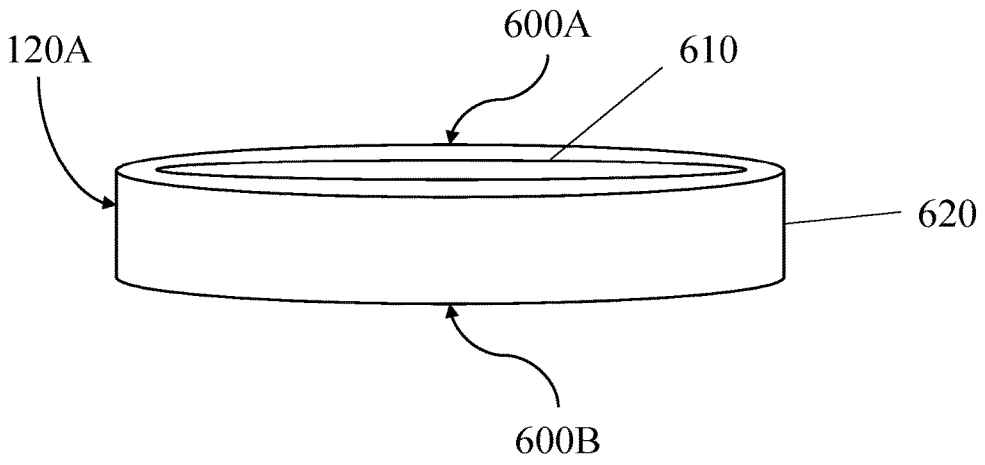
FIG. 6A is a top perspective view of a lid of a third component of the multi-configuration apparatus represented in FIG. 1, in accordance with exemplary embodiments of the present invention.
Figure 6B:
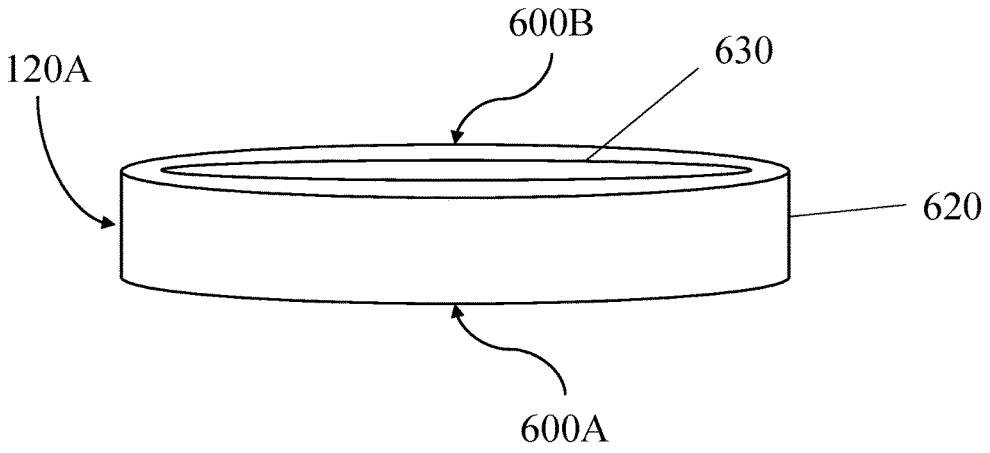
FIG. 6B is a bottom perspective view of a lid of a third component of the multi-configuration apparatus represented in FIG. 1, in accordance with exemplary embodiments of the present invention.
Figure 6C:
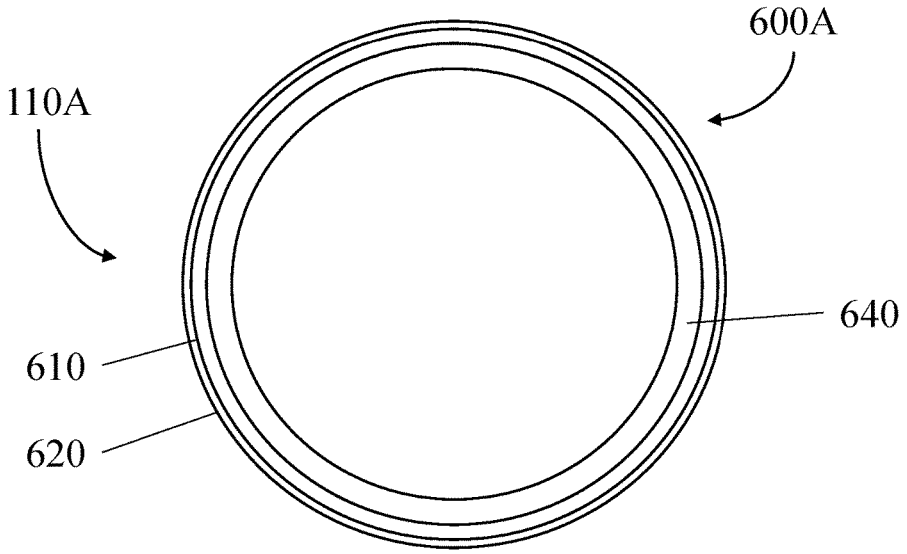
FIG. 6C is a top view of a lid of a third component of the multi-configuration apparatus represented in FIG. 1, in accordance with exemplary embodiments of the present invention.
Figure 6D:
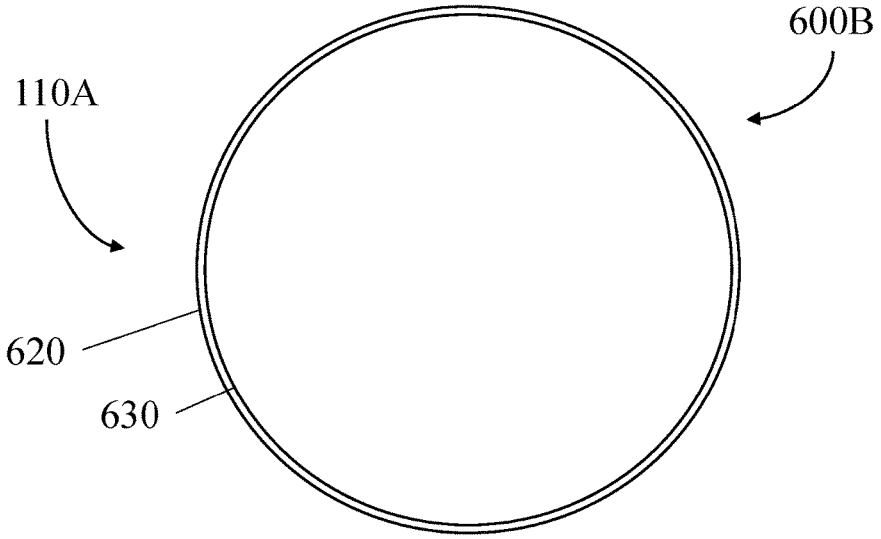
FIG. 6D is a bottom view of a lid of a third component of the multi-configuration apparatus represented in FIG. 1, in accordance with exemplary embodiments of the present invention.

Referring back to FIG. 1, Third Component 120, in embodiments, includes Third Lid 120A, and Third Chamber 120B. Referring to FIGS. 6A, 6B, 6C, and 6D, a top-perspective, bottom-perspective, top, and bottom view of Third Lid 120A respectively, Third Lid 120A includes Third Top 600A, Third Bottom 600B, Third Upper Engagement Insert 610 (as shown in FIG. 6A and FIG. 6C), Third Circumference 620, Third Lower Engagement Insert 630 (as shown in FIG. 6B and FIG. 6D), and Third Silicone Ring 640 (as shown in FIG. 6C).

Third Upper Engagement Insert 610 may be embedded within the interior rim of Third Top 600A. In embodiments, the diameter of the embedded Third Upper Engagement Insert 610 is configured to receive the diameter of First Top Feature 810. The depth of the embedded Third Engagement Insert 610 is, in embodiments, configured to receive all First Top Feature 810 such that the interior rim of Third Top 600A is adjacent to and in contact with Top 130. In embodiments, the diameter of the embedded Third Upper Engagement Insert 610 is configured to receive the diameter of Second Top Feature 910. The depth of the embedded Third Engagement Insert 610 is, in embodiments, configured to receive all Second Top Feature 910 such that the interior rim of Third Top 600A is adjacent to and in contact with Top 130.

In embodiments, Third Silicone Ring 640 may be embedded within the interior rim of Third Top 600A. Third Silicone Ring 640, in embodiments, may be located inside Third Upper Engagement insert 610 such that Third Silicone Ring 640 is in contact with Third Upper Engagement insert 610. Third Silicone Ring 640 may be configured to ensure a hermetic seal between a detachably engaged Third Lid 120A and Third Chamber 120B.

In embodiments, Third Upper Engagement Insert 610 may include threading configured to be affixed by threaded engagement to external threads on one or more of First Top Feature 810 and Second Top Feature 910.

In embodiments, Third Upper Engagement Insert 610 may be protruding from within the interior rim of Third Top 600A. In embodiments, the diameter of the embedded Third Upper Engagement Insert 610 is configured to be received within a diameter of one or more of an embedded First Top Feature 810 and an embedded Second Top Feature 910. The height of the protruding Third Upper Engagement Insert 610 is, in embodiments, configured to fit completely inside one or more of an embedded First Top Feature 810 and an embedded Second Top Feature 910 such that the interior rim of Third Top 600A is adjacent to and in contact with Top 130.

Third Lower Engagement Insert 630 may be embedded within the interior rim of Third Bottom 600B. In embodiments, the diameter of the embedded Third Lower Engagement Insert 630 is configured to receive the diameter of Third Upper Feature 720. The depth of the embedded Third Lower Engagement Insert 630 is, in embodiments, configured to receive all Third Upper Feature 720 such that the interior rim of Third Bottom 600B is adjacent to and in contact with Third hollow Chamber 730.

In embodiments, Third Lower Engagement Insert 630 may include threading configured to be affixed by threaded engagement to external threads on Third Upper Feature 720.

In embodiments, Third Lower Engagement Insert 630 may be protruding from within the interior rim of Third Bottom 600B. In embodiments, the diameter of the embedded Third Lower Engagement Insert 630 may be protruding from within the interior rim of Third Lower Engagement Insert 430 is configured to be received within a diameter of an embedded Third Upper Feature 720. The height of the protruding Third Lower Engagement Insert 630 is, in embodiments, configured to fit completely inside the embedded Third Upper Feature 720 such that the interior rim of Third Bottom 600B is adjacent to and in contact with Third hollow Chamber 730.

In embodiments, Third Circumference 620 may be circular in shape and have a radius similar to that of Multi-Configuration Apparatus 1. Third Circumference 620 may have the same radius as Third hollow Chamber 730. In embodiments, Third Circumference 620 may have a smaller radius than the radius of Third hollow Chamber 730. Third Circumference 620 may have a larger radius than Third hollow Chamber 730.

Figure 7A:
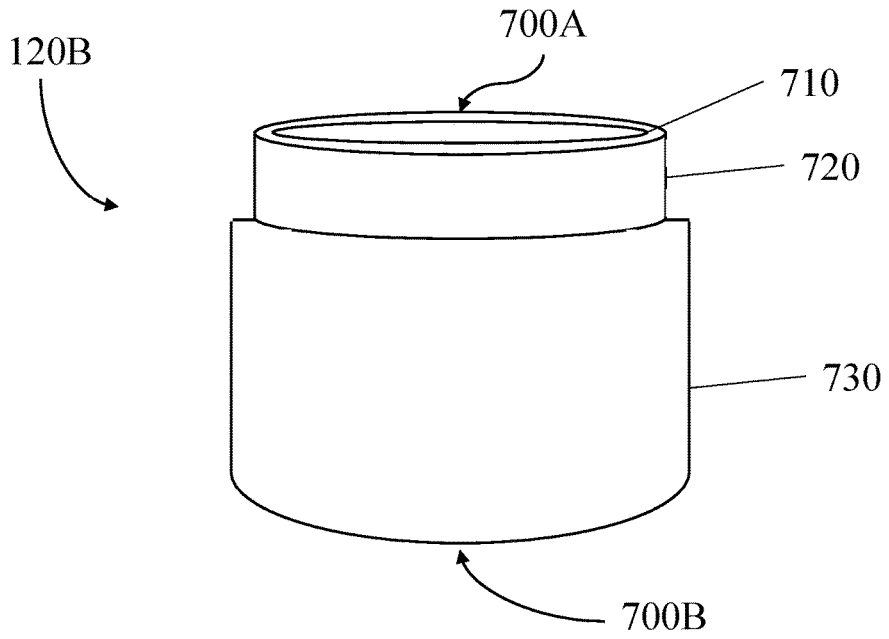
FIG. 7A is a top perspective view of a chamber of a third component of the multi-configuration apparatus represented in FIG. 1, in accordance with exemplary embodiments of the present invention.
Figure 7B:
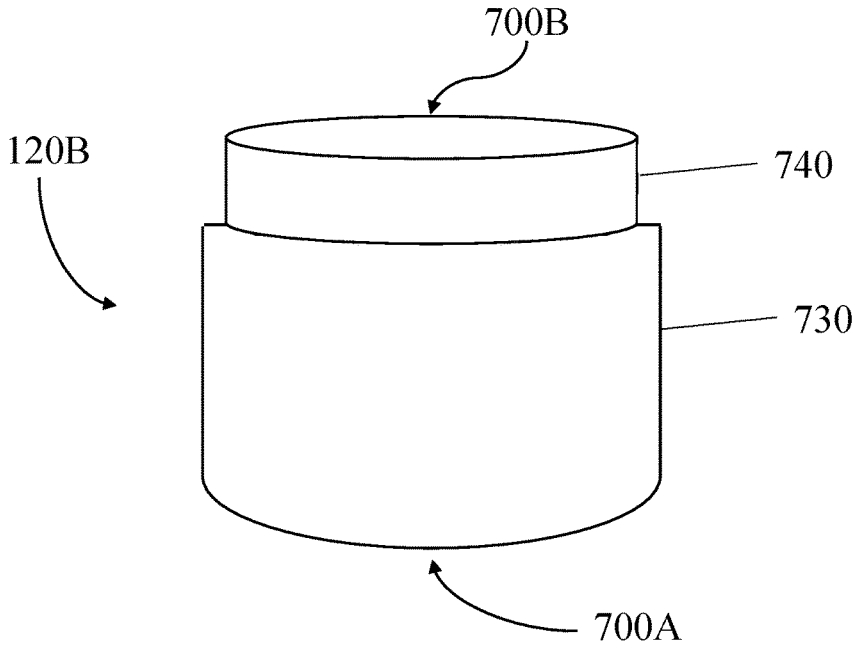
FIG. 7B is a bottom perspective view of a chamber of a third component of the multi-configuration apparatus represented in FIG. 1, in accordance with exemplary embodiments of the present invention.

Referring back to FIG. 1, Third Component 120 includes Third Lid 120A, and Third Chamber 120B. Referring to FIGS. 7A and 7B, a top-perspective and bottom-perspective view of Third Chamber 120B, respectively, Third Chamber 120B includes Third Chamber Top 700A; Third Chamber Bottom 700B; Third Opening 710; Third Upper Feature 720; Third hollow Chamber 730; and Third Lower Feature 740.

Third Opening 710 is a designed aperture through which the contents of Third hollow Chamber 730 can be accessed or deposited. Third Opening 710, as shown in FIG. 7A, is located at Third Chamber Top 700A. Third Opening 710, in embodiments, is circular in shape and proportionate in size to Third Component 120. The proportion in size, for example, may be Third Opening 710 diameter to Third Component 120 height (the height of Third Component 120 is the distance between Third Chamber Bottom 700B and Third Top 600A). As an exemplary range, a Third Opening 710 diameter to Third Component 120 height ratio, Third Opening 710 diameter may comprise 125% to 250% of Second Component 110 height. For example, Third Opening 710 diameter may be 125% of Third Component 120 height. For instance, being 125% of Third Component 120 height, if Third Opening 710 diameter is 2.25 inches, Third Component 120 height is 2 inches. As another example, Third Opening 710 diameter may be 250% of Third Component 120 height. For instance, being 250% of Third Component 120 height, if Third Opening 710 diameter is 2.25 inches, Third Component 120 height is 1 inch.

Third Opening 710 is configured to be hermetically sealed when Third Chamber 120B is detachably engaged to Third Lid 120A. As shown in FIG. 7A, Third Opening 710, is an opening within Third Upper Feature 720. Third Upper Feature 720 may protrude from Third hollow Chamber 730. In embodiments, the diameter of the protruding Third Upper Feature 720 is configured to be received by Third Lower Engagement Insert 630. The height of the protruding Third Upper Feature 720, in embodiments, is configured such that when Third Upper Feature 720 is detachably engaged with Third Lower Engagement Insert 630, Third hollow Chamber 730 is adjacent to and in contact with the interior of the rim of Third Bottom 600B.

In embodiments, Third Upper Feature 720 may include exterior threads, which may be on the outer rim or interior rim of Third Upper Feature 720. The exterior threads may be configured to be affixed by threaded engagement to a threaded insert of Third Bottom 600B (i.e., Third Lower Engagement Insert 630).

Third Upper Feature 720 may be embedded within the interior of Third hollow Chamber 730. In embodiments, the diameter of the embedded Third Upper Feature 720 is configured to receive the diameter of Third Lower Engagement Insert 630. The depth of the embedded Third Upper Feature 720, in embodiments, is configured such that when Third Upper Feature 720 is detachably engaged with Third Lower Engagement Insert 630, Third hollow Chamber 730 is adjacent to and in contact with the interior of the rim of Third Bottom 600B.

In embodiments, Third Opening 710 may include external threads along a perimeter around Third Opening 710, the external threads being configured to detachably engage to Third Lid 120A.

Third hollow Chamber 730 is an enclosed space within Third Component 120 and is configured to receive and store liquid laundry detergent, liquid fabric softener, liquid stain remover or pre-treatment, color-safe bleach, bleach, delicate fabric detergent, HE (High Efficiency) laundry detergent, eco-friendly, laundry detergent, liquid detergent for baby clothes, scented beads, dryer sheets, fiat (including paper fiat and coins sufficient to purchase one or more cycles of a laundry machine or a dryer), sports laundry detergent, and dark care laundry detergent, to name a few. Third hollow Chamber 730, in embodiments, is made of a translucent material, for example, Tritan. Third hollow Chamber 730, in embodiments, has a volume of 9 fluid ounces. In embodiments, Third hollow Chamber 730 has a volume of 5 fluid ounces.

As shown in FIG. 7B, Third Lower Feature 740 may protrude from Third hollow Chamber 730. In embodiments, the diameter of the protruding Third Lower Feature 720 is configured to be received by Second Upper Engagement Insert 410. The height of the protruding Third Lower Feature 740, in embodiments, is configured such that when Third Lower Feature 740 is detachably engaged with Second Upper Engagement Insert 410, Third hollow Chamber 730 is adjacent to and in contact with the Second Component 110. In embodiments, Third Lower Feature 740 may include exterior threads, which may be on the outer rim or interior rim of Third Lower Feature 740. The exterior threads may be configured to be affixed by threaded engagement to Second Upper Engagement Insert 410.

Figure 8:
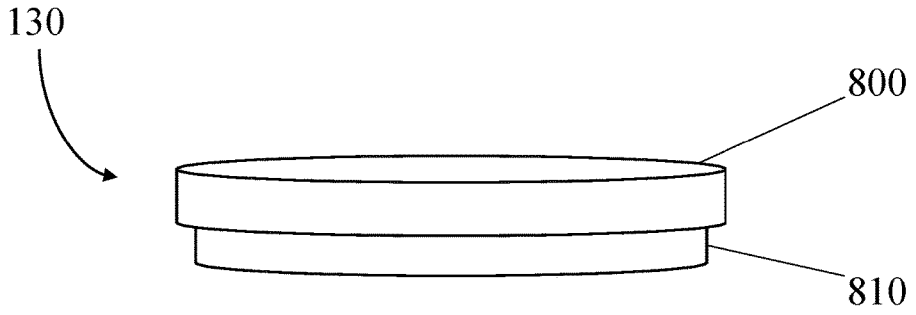
FIG. 8 is a top perspective view of a top of the multi-configuration apparatus represented in FIG. 1, in accordance with exemplary embodiments of the present invention.

Referring back to FIG. 1, Multi-Configuration Apparatus 1 includes Top 130. As shown in FIG. 8, Top 130 may include First Top Lid 800 and First Top Feature 810.

In embodiments of the present invention, Top 130 is uniquely engineered with an internal threading mechanism. This is achieved by integrating external threading on the First Top Feature 810 which is configured to detachably engage with a threaded insert of Third Lid 120 A. For example, First Top Feature 810 may protrude from First Top Lid 800. In embodiments, the diameter of the protruding First Top Feature 810 is configured to be received by Third Upper Engagement Insert 610. The height of the protruding First Top Feature 810, in embodiments, is configured such that when First Top Feature 810 is detachably engaged with Third Upper Engagement Insert 610, Third hollow Chamber 730 is adjacent to and in contact with First Top Lid 800. In embodiments, First Top Feature 810 may include exterior threads, which may be on the outer rim or interior rim of First Top Feature 810. The exterior threads may be configured to be affixed by threaded engagement to Third Upper Engagement Insert 610. Unlike conventional designs, in embodiments, the threaded engagement via external threads (as shown in FIGS. 6A and 8) embeds the external threads inside the Third Upper Engagement Insert 610. This internal threading ensures a secure and precise engagement with a corresponding threaded component. The inclusion of this internal threaded insert offers a streamlined exterior profile for the cylinder while maintaining the functional advantage of a threaded connection for secure closure or attachment purposes.

Figure 9:
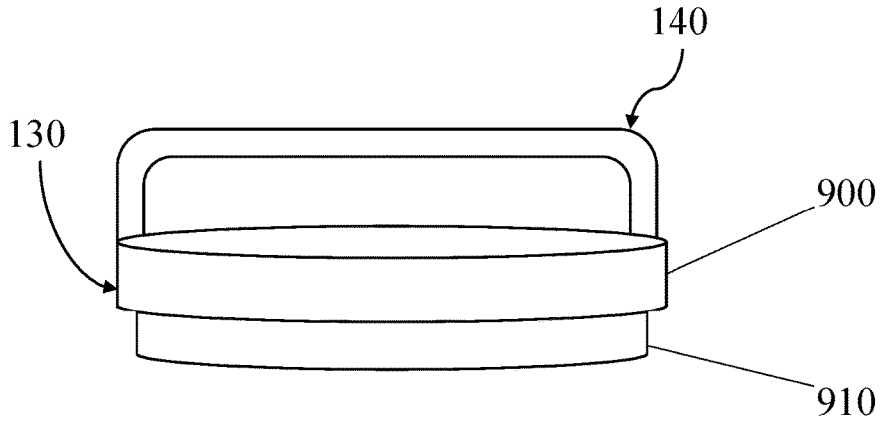
FIG. 9 is another top perspective view of a lid of the multi-configuration apparatus represented in FIG. 1, in accordance with exemplary embodiments of the present invention.

In embodiments, referring to FIG. 9, Top 130 may include Second Lid 900, Second Top Feature 910, and Handle 140. In embodiments, Handle 140 is affixed by detachable engagement to Top 130 and is configured to support the weight of Multi-Configuration Apparatus 1 when all of the components are full of various contents. For example, if First Component 100 includes laundry detergent, Second Component 110 includes fabric softener, and Third Component 120 includes fiat, Handle 140 is configured to support Multi-Configuration Apparatus 1.

In embodiments, Second Top Feature 910 may protrude from Second Top Lid 900. In embodiments, the diameter of the protruding Second Top Feature 910 is configured to be received by Third Upper Engagement Insert 610. The height of the protruding Second Top Feature 910, in embodiments, is configured such that when Second Top Feature 910 is detachably engaged with Third Upper Engagement Insert 610, Third hollow Chamber 730 is adjacent to and in contact with Second Top Lid 900. In embodiments, Second Top Feature 910 may include exterior threads, which may be on the outer rim or interior rim of Second Top Feature 910. The exterior threads may be configured to be affixed by threaded engagement to Third Upper Engagement Insert 610. Unlike conventional designs, in embodiments, the threaded engagement via external threads (as shown in FIGS. 6A and 9) embeds the external threads inside the Third Upper Engagement Insert 610. This internal threading ensures a secure and precise engagement with a corresponding threaded component. The inclusion of this internal threaded insert offers a streamlined exterior profile for the cylinder while maintaining the functional advantage of a threaded connection for secure closure or attachment purposes.

In embodiments, Top 130 may include a Second Bottom Feature (not shown). Second Bottom Feature may protrude from Second Top Lid 900 (e.g., on the opposite side of Second Top Lid 900 such that Second Top Feature 910 is on the opposite side of Second Top Lid 900 as compared to Second Bottom Feature).

In embodiments, the diameter of the protruding Second Bottom Feature is configured to be received by a Handle Engagement Insert. Handle Engagement Insert may be embedded within the bottom rim of Handle 140. The height of the protruding Second Bottom Feature, in embodiments, is configured such that when Second Bottom Feature is detachably engaged with Handle Engagement Insert, Top 130 is adjacent to and in contact with Handle 140. In embodiments, Second Bottom Feature may include exterior threads, which may be on the outer rim or interior rim of Second Bottom Feature. The exterior threads may be configured to be affixed by threaded engagement to Handle Engagement Insert.

Second Bottom Feature may be embedded within the interior of Top 130. In embodiments, the diameter of the embedded Second Bottom Feature is configured to receive the diameter of Handle Engagement Insert. The depth of the embedded Second Bottom Feature, in embodiments, is configured such that when Second Bottom Feature is detachably engaged with Handle Engagement Insert, Top 130 is adjacent to and in contact with Handle 140. In embodiments, Top 130 is made from PP Thermoplastic. In embodiments, PP Thermoplastic is used for its durability and ability to create a harmonic seal with Third Component 120.

In embodiments, one or more components or pieces therein of Multi-Configuration Apparatus 1 may be detachably engaged via threaded engagement. This mechanism operates on the principle of matching helical threads on both the chamber's opening and a threaded insert within the lid. When the lid and/or chamber is rotated, these threads interlock, pulling the lid downwards to form a secure closure. The depth, pitch, and shape of these threads are crucial design elements, as they determine the ease of opening and closing and the seal's effectiveness. This type of engagement is particularly advantageous for creating an airtight and leak-proof seal. This method of detachable engagement also allows for reusability, as the lid can be easily removed and reattached multiple times without compromising the integrity of the seal.

Multi-Configuration Apparatus 1 may have multiple configurations. While one configuration is shown in FIG. 1 (i.e., First Component 100 affixed to Second Component 110 which is affixed to Third Component 120, which is affixed to Top 130), multiple configurations are possible. In embodiments, Multi-Configuration Apparatus 1 is configured to accommodate one or more of the following configurations: (1) First Component 100 affixed to Second Component 110 which is affixed to Third Component 120, which is affixed to Top 130; (2) First Component 100 affixed to Third Component 120 which is affixed to Second Component 110, which is affixed to Top 130; (3) Second Component 110 affixed to First Component 100 which is affixed to Third Component 120, which is affixed to Top 130; (4) Second Component 110 affixed to Third Component 120 which is affixed to First Component 100, which is affixed to Top 130; (5) Third Component 120 affixed to First Component 100 which is affixed to Second Component 110, which is affixed to Top 130; and (6) Third Component 120 affixed to Second Component 110 which is affixed to First Component 100, which is affixed to Top 130. In embodiments, detaching one or more components of Multi-Configuration Apparatus 1 does not effect the hermetic seals between each component's lid and chamber.

Figure 10:
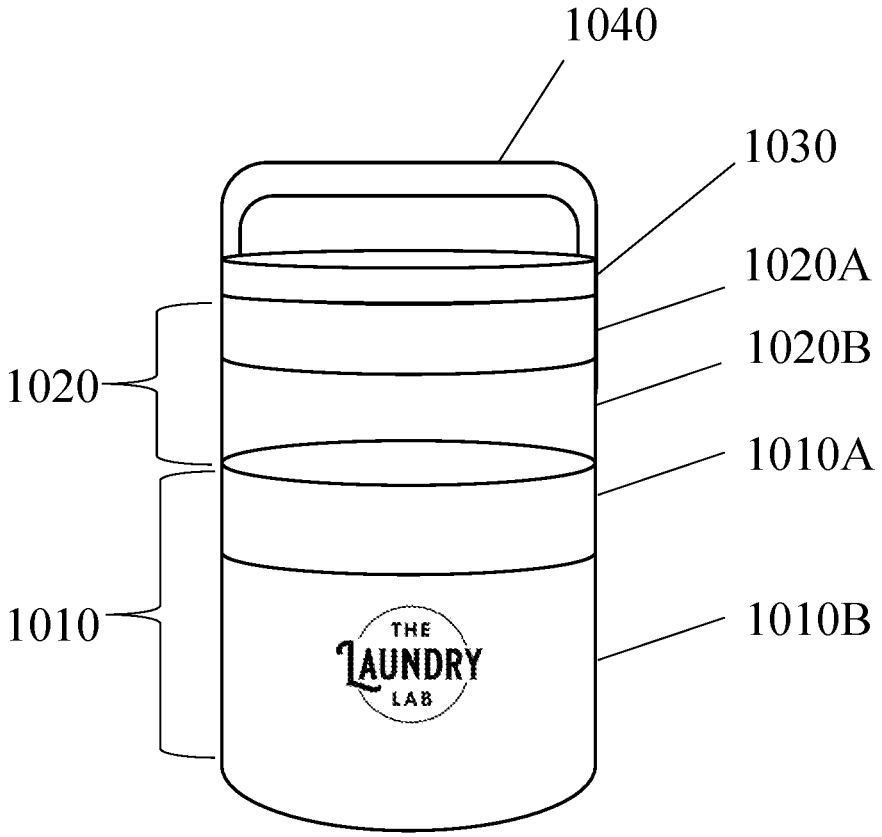
FIG. 10 is another schematic diagram of a multi-configuration apparatus in accordance with exemplary embodiments of the present invention.

Multi-Configuration Apparatus 1 may also have varying amounts of components. For example, referring to FIG. 10, Multi-Configuration Apparatus 1 may include First Component 1010; Second Component 1020; and Top 1030. Top 1030 may include Handle 1040. Similar to the description of FIG. 1, in embodiments, First Component 1010 and Second Component 1020, may each include a lid (i.e., First Lid 1010A and Second Lid 1020A, respectively) and a hollow chamber (i.e., First Chamber 1010B and Second Chamber 1020B, respectively). First Component 1010, Second Component 1020, Top 1030, and Handle 1040 and the components therein, may be similar to the description of First Component 100, Second Component 110, Third Component 120, Top 130, and Handle 140, described above in connection with FIGS. 1-9, the descriptions of which apply herein.

Figure 11:
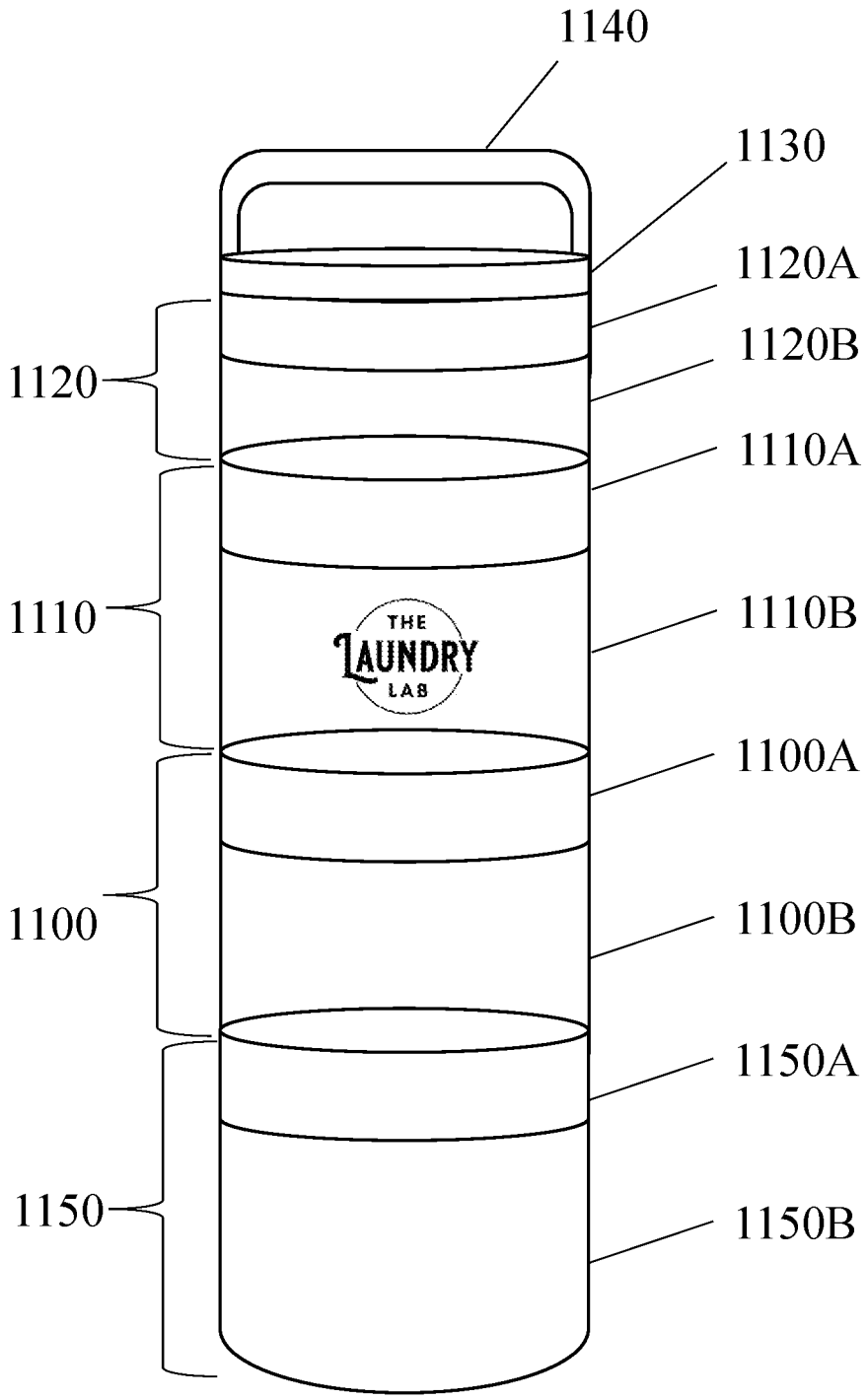
FIG. 11 is another schematic diagram of a multi-configuration apparatus in accordance with exemplary embodiments of the present invention.

As another example, referring to FIG. 11, Multi-Configuration Apparatus 1 may include First Component 1100, Second Component 1110, Third Component 1120, Fourth Component 1150, Top 1130, and Handle 1140. Similar to the description of FIG. 1, in embodiments, First Component 1100, Second Component 1110, Third Component 1120, Fourth Component 1150 may each include a lid (i.e., First Lid 1100A, Second Lid 1110A, Third Lid 1120A, and Fourth Lid 1150A, respectively) and a hollow chamber (i.e., First Chamber 1100B, Second Chamber 1100B, Third Chamber 1120B, and Fourth Chamber 1150B, respectively). Fourth Component 1150 and the components therein may be similar to the description of First Component 1010, Second Component 1020, and Third Component described above in connection with FIGS. 1-9, the descriptions of which applying herein. First Component 1100, Second Component 1110, Third Component 1120, Top 1130, and Handle 1140 and the components therein, may be similar to the description of First Component 100, Second Component 110, Third Component 120, Top 130, and Handle 140, described above in connection with FIGS. 1-9, the descriptions of which apply herein.

EXAMPLE

Users of Multi-Configuration Apparatus 1 may add the required contents to three chambers: First Chamber 100B, Second Chamber 110B, and Third Chamber 120B. Once the materials are in place, the next step involves sealing each component hermetically. This is achieved by detachably engaging the corresponding lids to their respective chambers: First Lid 100A to First Chamber 100B, Second Lid 110A to Second Chamber 110B, and Third Lid 120A to Third Chamber 120B. Each of these combinations forms a hermetically sealed unit. Finally, the assembly of Multi-Configuration Apparatus 1 is completed by detachably engaging First Component 100, Second Component 110, Third Component 120, and Top 130. This ensures that all components are securely attached and ready for use.

At a communal laundry facility, a user may detach the assembled units: First Component 100, Second Component 110, Third Component 120, and the Top 130 may all be separated from one another. After this, the lid of each component is removed from its chamber, enabling the contents of each component to be utilized. Once the contents have been used, each lid is detachably engaged to its respective chamber. This process involves securely engaging the lids back onto the chambers, ensuring that each component is closed and ready for subsequent use or storage.

Now that embodiments of the present invention have been shown and described in detail, various modifications and improvements thereon can become readily apparent to those skilled in the art. Accordingly, the exemplary embodiments of the present invention, as set forth above, are intended to be illustrative, not limiting. The spirit and scope of the present invention is to be construed broadly.

What is claimed:

1. A multi-configuration apparatus comprising:

a top component, comprising:

a first top side, the top first side being circular in shape and comprising a top first side external threads; and a top second side, the top second side comprising a handle section including a handle opening;

a first component comprising:

a first chamber having a first volume, the first chamber comprising:

a first chamber first side, the first chamber first side comprising a first circular opening and a first chamber first side external threads;

a first chamber second side, the first chamber second side being circular in shape and comprising a first chamber second side external threads; and a first lid comprising:

a first lid first side, the first lid first side being circular in shape and comprising:

a first lid first side threaded insert; and a first lid first side rim, the first lid first side rim being within a circumference of the first lid;

a first lid second side, the first lid second side being circular in shape and comprising:

a first lid second side threaded insert;

a first lid second side rim, the first lid second side rim being within the circumference of the first lid; and a first lid silicon insert, wherein the first lid silicon insert is circular in shape and positioned within the first lid second side rim, and wherein the first lid silicon insert is adjacent to and in contact with the first lid second side threaded insert, wherein the first chamber is affixed to the first lid by threaded engagement between the first chamber first side external threads and the first lid second side threaded insert;

a second component comprising:

a second chamber having a second volume, the second chamber comprising:

a second chamber first side, the second chamber first side comprising a second circular opening and a second chamber first side external threads;

a second chamber second side, the second chamber second side being circular in shape and comprising a second chamber second side external threads; and a second lid comprising:

a second lid first side, the second lid first side being circular in shape and comprising:

a second lid first side threaded insert; and a second lid first side rim, the second lid first side rim being within a circumference of the second lid; and a second lid second side, the second lid second side being circular in shape and comprising:

a second lid second side threaded insert;

a second lid second side rim, the second lid second side rim being within the circumference of the second lid; and a second lid silicon insert, wherein the second lid silicon insert is circular in shape and positioned within the second lid second side rim, and wherein the second lid silicon insert is adjacent to and in contact with the second lid second side threaded insert, wherein the second chamber is affixed to the second lid by threaded engagement between the second chamber first side external threads and the second lid second side threaded insert; and a third component comprising:

a third chamber having a third volume, the third chamber comprising:

a third chamber first side, the third chamber first side comprising a third circular opening and a third chamber first side external threads; and a third chamber second side, the third chamber second side being circular in shape and comprising a third chamber second side external threads; and a third lid comprising:

a third lid first side, the third lid first side being circular in shape and comprising:

a third lid first side threaded insert; and a third lid first side rim, the third lid first side rim being within a circumference of the third lid; and a third lid second side, the third lid second side being circular in shape and comprising:

a third lid second side threaded insert;

a third lid second side rim, the third lid second side rim being within the circumference of the third lid; and a third lid silicon insert, wherein the third lid silicon insert is circular in shape and positioned within the third lid second side rim, and wherein the third lid silicon insert is adjacent to and in contact with the third lid second side threaded insert, wherein the third chamber is affixed to the third lid by threaded engagement between the third chamber first side external threads and the third lid second side threaded insert, wherein the first volume is less than the second volume, wherein the first volume is less than the third volume, wherein the second volume and the third volume are the same, wherein the multiconfiguration apparatus comprises: a first configuration comprising a first order of components and a second configuration comprising a second order of components, such that the first order of components differs from the second configuration of components, wherein the first order comprises the top affixed to the first component, the first component affixed to the second component, and the second component affixed to the third component, the first component being affixed to the top by threaded engagement between the top first side external threads and first lid first side threaded insert, the second component being affixed to the first component by threaded engagement between the first chamber second side external threads and the second lid first side threaded insert, and the third component being affixed to the second component by threaded engagement between the second chamber second side external threads and the third lid first side threaded insert, wherein the first configuration has a first cylindrical shape, wherein the second order comprises the top affixed to the first component, the first component affixed to the third component, and the third component affixed to the second component, the first component being affixed to the top by threaded engagement between the top first side external threads and first lid first side threaded insert, the third component is affixed to the first component by threaded engagement between the first chamber second side external threads and the third lid first side threaded insert, and the second component is affixed to the third component by threaded engagement between the third chamber second side external threads and the second lid first side threaded insert, and wherein the second configuration has a second cylindrical shape.

2. The multi-configuration apparatus of claim 1, wherein the first configuration has a height of nine inches and a diameter of 2.25 inches.

3. The multi-configuration apparatus of claim 1, wherein the second configuration has a height of nine inches and a diameter of 2.25 inches.

4. The multi-configuration apparatus of claim 1, wherein the first chamber, the second chamber, and the third chamber are made of Tritan.

5. The multi-configuration apparatus of claim 1, wherein the first volume is 5 fluid ounces, the second volume is 9 fluid ounces, and the third volume is 9 fluid ounces.

6. The multi-configuration apparatus of claim 1, wherein, the second chamber further comprises:

a first plurality of marks comprising:

a first mark between the second chamber first side and the second chamber second side, such that the first marking is perpendicular to the second chamber first side and the second chamber second side;

a second mark that originates from the first mark at a first point and runs perpendicular to the first mark;

a third mark that originates from the first mark at a second point and runs perpendicular to the first mark;

a fourth mark that originates from the first mark at a third point and runs perpendicular to the first mark; and a fifth mark that originates from the first mark at a fourth point and runs perpendicular to the first mark, wherein a first distance between the second chamber second side and the first point is equal to a second distance between the first point and the second point, wherein the second distance is equal to a third distance between the second point and the third point, and wherein the third distance is equal to a fourth distance between the third point and the fourth point.

7. The multi-configuration apparatus of claim 6, wherein the first distance measures a first amount of laundry detergent sufficient to clean one load of laundry in a washing machine, the second distance measures a second amount of laundry detergent sufficient to clean two loads of laundry, the third distance measures a third amount of laundry detergent sufficient to clean three loads of laundry, and the fourth distance measures a fourth amount of laundry detergent sufficient to clean four loads of laundry.

8. The multi-configuration apparatus of claim 7, wherein one load of laundry is between 10 pounds and 18 pounds.

9. The multi-configuration apparatus of claim 6, wherein the first distance measures a first amount of fabric softener sufficient for one load of laundry in a washing machine, the second distance measures a second amount of fabric softener sufficient for two loads of laundry, the third distance measures a third amount of fabric softener sufficient for three loads of laundry, and the fourth distance measures a fourth amount of fabric softener sufficient for four loads of laundry.

10. The multi-configuration apparatus of claim 9, wherein one load of laundry is between 10 pounds and 18 pounds.

11. The multi-configuration apparatus of claim 1, wherein, the third chamber further comprises:

a second plurality of marks comprising:

a sixth mark between the third chamber first side and the third chamber second side, such that the sixth marking is perpendicular to the third chamber first side and the third chamber second side;

a seventh mark that originates from the sixth mark at a fifth point and runs perpendicular to the sixth mark;

an eighth mark that originates from the sixth mark at a sixth point and runs perpendicular to the sixth mark;

a ninth mark that originates from the sixth mark at a seventh point and runs perpendicular to the sixth mark; and a tenth mark that originates from the sixth mark at an eighth point and runs perpendicular to the sixth mark, wherein a fifth distance between the third chamber second side and the fifth point is equal to a sixth distance between the fifth point and the sixth point, wherein the sixth distance is equal to a seventh distance between the sixth point and the seventh point, and wherein the seventh distance is equal to an eighth distance between the seventh point and the fourth point.

12. The multi-configuration apparatus of claim 9, wherein the fifth distance measures a fifth amount of laundry detergent sufficient to clean one load of laundry in a washing machine, the sixth distance measures a sixth amount of laundry detergent sufficient to clean two loads of laundry, the seventh distance measures a seventh amount of laundry detergent sufficient to clean three loads of laundry, and the eighth distance measures an eighth amount of laundry detergent sufficient to clean four loads of laundry.

13. The multi-configuration apparatus of claim 10, wherein one load of laundry is between 10 pounds and 18 pounds.

14. The multi-configuration apparatus of claim 1, wherein the threaded engagement between the first lid and the first chamber forms a hermetic seal, the threaded engagement between the second lid and the second chamber forms a hermetic seal, and the threaded engagement between the third lid and the third chamber forms a hermetic seal.

15. The multi-configuration apparatus of claim 1, wherein:

the first chamber is configured to hold fiat;

the second chamber is configured to hold fabric softener, and the third chamber is configured to hold laundry detergent.

16. A multi-configuration apparatus comprising a top component, a first component and a second component, the top component comprising:

a first top comprising a top first side engagement feature;

a first component comprising:

a first chamber comprising:

a first chamber first side, the first chamber first side comprising a first opening and first chamber first side engagement feature;

a first chamber second side comprising a first chamber second side engagement feature; and a first lid comprising:

a first lid first side comprising a first lid first side engagement feature insert; and a first lid second side comprising a first lid second side engagement feature insert, wherein the first chamber is affixed to the first lid by detachable engagement between the first chamber first side first engagement feature and the first lid second side engagement feature insert;

a second component comprising:

a second chamber comprising:

a second chamber first side, the second chamber first side comprising a second opening and second chamber first side engagement feature;

a second chamber second side comprising a second chamber second side engagement feature; and a second lid comprising:

a second lid first side comprising a second lid first side engagement feature insert; and a second lid second side comprising a second lid second side engagement feature insert, wherein the second chamber is affixed to the second lid by detachable engagement between the second chamber first side engagement feature and the second lid second side engagement feature insert; and a third component comprising:

a third chamber comprising:

a third chamber first side comprising a third opening and a third chamber first side engagement feature; and a third chamber second side comprising a third chamber second side engagement feature; and a third lid comprising:

a third lid first side comprising a third lid first side engagement feature insert; and a third lid second side comprising a third lid second side engagement feature insert, wherein the third chamber is affixed to the third lid by detachable engagement between the third chamber first side engagement feature and the third lid second side engagement feature insert, wherein the multiconfiguration apparatus comprises: a first configuration comprising a first order of components and a second configuration comprising a second order of components, such that the first order of components differs from the second configuration of components, wherein the first order comprises the top affixed to the first component, the first component affixed to the second component, and the second component affixed to the third component, the first component being affixed to the top by detachable engagement between the top first side engagement feature and first lid first side engagement feature insert, the second component being affixed to the first component by detachable engagement between the first chamber second side engagement feature and the second lid first side engagement feature insert, and the third component being affixed to the second component by detachable engagement between the second chamber second side engagement feature and the third lid first side engagement feature insert, wherein the second order comprises the top affixed to the first component, the first component affixed to the third component, and the third component affixed to the second component, the first component being affixed to the top by detachable engagement between first lid first side engagement feature and the top second side engagement feature insert, the third component is affixed to the first component by detachable engagement between the first chamber second side engagement feature and the third lid first side engagement feature insert, and the second component is affixed to the third component by detachable engagement between the third chamber second side engagement feature and the second lid first side engagement feature insert.

17. The multi-configuration apparatus of claim 16, wherein the first configuration has a height of less than nine inches and a diameter of less than 2.5 inches.

18. The multi-configuration apparatus of claim 16, wherein the second configuration has a height of less than nine inches and a diameter of less than 2.5 inches.

19. The multi-configuration apparatus of claim 16, wherein:

the first chamber has a first volume;

the second chamber has a second volume; and the third chamber has a third volume, and wherein the first volume is 5 fluid ounces, the second volume is 9 fluid ounces, and the third volume is 9 fluid ounces.

20. The multi-configuration apparatus of claim 16, further comprising a fourth component comprising:

a fourth chamber comprising:

a fourth chamber first side comprising a third opening and a fourth chamber first side engagement feature; and a fourth chamber second side comprising a fourth chamber second side engagement feature; and a fourth lid comprising:

a fourth lid first side comprising a fourth lid first side engagement feature insert; and a fourth lid second side comprising a fourth lid second side engagement feature insert, wherein the fourth chamber is affixed to the fourth lid by detachable engagement between the fourth chamber first side engagement feature and the fourth lid second side engagement feature insert.

* * * * *